US008929762B2

(12) United States Patent
Shinagawa et al.

(10) Patent No.: US 8,929,762 B2
(45) Date of Patent: Jan. 6, 2015

(54) IMAGE HEATING APPARATUS WITH AN AIR FEEDING DEVICE CONFIGURED TO FEED AIR TO A BELT COOPERATING WITH A HEATING ROTATABLE MEMBER TO FORM A NIP FOR HEATING AN IMAGE ON RECORDING MATERIAL

(75) Inventors: Akiyoshi Shinagawa, Kashiwa (JP); Oki Kitagawa, Kashiwa (JP); Shigeaki Takada, Abiko (JP); Hiroki Kawai, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 240 days.

(21) Appl. No.: 13/593,000

(22) Filed: Aug. 23, 2012

(65) Prior Publication Data

US 2013/0051831 A1 Feb. 28, 2013

(30) Foreign Application Priority Data

Aug. 26, 2011 (JP) ..... 2011-184295

(51) Int. Cl.
*G03G 15/20* (2006.01)
*G03G 21/20* (2006.01)

(52) U.S. Cl.
CPC ..... *G03G 15/2039* (2013.01); *G03G 15/2032* (2013.01); *G03G 21/206* (2013.01)
USPC ..... 399/69; 399/329

(58) Field of Classification Search
USPC ..... 399/400, 92, 45, 329, 69
See application file for complete search history.

(56) References Cited

U.S. PATENT DOCUMENTS

| | | | | |
|---|---|---|---|---|
| 7,106,986 | B2 | 9/2006 | Nakayama | |
| 7,200,354 | B2 | 4/2007 | Nakamoto et al. | |
| 7,457,576 | B2 | 11/2008 | Takada et al. | |
| 7,466,950 | B2 | 12/2008 | Matsuura et al. | |
| 7,596,348 | B2 | 9/2009 | Nakamoto et al. | |
| 7,844,208 | B2 | 11/2010 | Hayashi et al. | |
| 7,965,955 | B2 | 6/2011 | Takahashi et al. | |
| 8,068,758 | B2 * | 11/2011 | Kaji | 399/92 |
| 8,208,833 | B2 | 6/2012 | Kitagawa | |
| 8,301,067 | B2 | 10/2012 | Takada | |
| 8,351,814 | B2 * | 1/2013 | Kasuga | 399/92 |
| 2006/0088326 | A1 | 4/2006 | Nakayama | |
| 2008/0008484 | A1 | 1/2008 | Takahashi et al. | |
| 2010/0284706 | A1 | 11/2010 | Ito et al. | |

(Continued)

FOREIGN PATENT DOCUMENTS

| | | | |
|---|---|---|---|
| JP | 2006-119430 | A | 5/2006 |
| JP | 2007-328161 | A | 12/2007 |
| JP | 2008-015419 | A | 1/2008 |
| JP | 2010-262221 | A | 11/2010 |
| JP | 2011-133612 | A | 7/2011 |

*Primary Examiner* — Susan Lee
(74) *Attorney, Agent, or Firm* — Fitzpatrick, Cella, Harper & Scinto

(57) ABSTRACT

An image heating apparatus includes a heating roller; a belt forming a heating nip; a heating device for heating the heating roller; a controller for controlling a temperature of the heating roller at temperature depending on thickness of sheet; an air feeding device for feeding air to the belt; an executing portion capable of executing an operation in a mode in which the air feeding device feeds the air into between the belt and the heating roller while the belt is spaced from the heating roller with the belt and the heating member being rotating. When a thin sheet is fed following a thick sheet, the executing portion executes the operation in the mode after the thick sheet passes through the nip and before the thin sheet is fed into the nip.

14 Claims, 11 Drawing Sheets

(56) References Cited

U.S. PATENT DOCUMENTS

2011/0222887 A1* 9/2011 Tao et al. ..... 399/69
2012/0003346 A1 1/2012 Chigono et al.
2012/0027444 A1 2/2012 Kitagawa
2012/0155940 A1 6/2012 Hagiwara et al.
2012/0251153 A1 10/2012 Takada

* cited by examiner (a) CONTACT STATE (b) SPACED STATE (a) 1ST COOLING MODE (b) 2ND COOLING MODE (a) 1ST COOLING MODE (b) 2ND COOLING MODE (a) 1ST COOLING MODE (b) 2ND COOLING MODE

IMAGE HEATING APPARATUS WITH AN AIR FEEDING DEVICE CONFIGURED TO FEED AIR TO A BELT COOPERATING WITH A HEATING ROTATABLE MEMBER TO FORM A NIP FOR HEATING AN IMAGE ON RECORDING MATERIAL

FIELD OF THE INVENTION AND RELATED ART

The present invention relates to an image heating apparatus for heating a toner image on a sheet of recording medium with the use of a nip. In particular, it relates to an image heating apparatus which has a pair of rotational heating members, a pair of circularly movable heating belts, and an air blowing device, and is structured so that both the rotational heating members and circularly movable belts can be separately controlled in temperature from each other, and also, so that the air blowing device is used for preventing the belts from excessively increasing in temperature.

Image heating apparatuses having a combination of a pair of rotational heating members and a pair of circularly movable belts, which form a nip for heating a toner image on a recording medium have been in use for quite some time. In the case of the image heating apparatuses structured as described above, it is desired that the belt temperature is kept below the temperature of the rotational heating member, in order to prevent the problem that recording medium is given an excessive amount of heat. One of the methods for keeping the belt temperature below the temperature of the rotational heating member is to provide an image heating apparatus with an air blowing device, which is positioned so that it faces the outward surface of the belt, in terms of the loop which the belt forms. With the image heating apparatus being provided with the air blowing device, it is possible to keep the belt temperature below the temperature of the rotational heating member, by blowing air at the belt, during an image forming operation (Japanese Laid-open Patent Application 2006-119430).

The belt temperature and rotational heating member temperature are desired to be adjusted according to the thickness of the recording medium. In other words, in a case where a substantial number of sheets of the recording medium, which are different in thickness, are successively conveyed through an image heating apparatus, the belt temperature and rotational heating member temperature have to be changed in temperature according to the recording medium thickness. For example, in a case where a sheet of thin paper is conveyed immediately following a sheet of thick paper, both the belt temperature and rotational heating member temperature have to be lowered.

Japanese Laid-open Patent Application 2006-119430 discloses a method which quickly reduces the temperature range of a rotational member by placing an air blowing device so that the air blowing device faces a belt. More specifically, this method transfers heat from the rotational heating member to the belt by blowing air at the belt with the use of an air blowing device while the rotational heating member and belt are kept in contact with each other. This method, however, increases the belt temperature while reducing the rotational heating member in temperature. Thus, it cannot quickly reduce both the temperature of the rotational heating member and the belt, and therefore, it is possible that the use of this method will increase the length of time it takes to change in temperature both the rotational heating member and belt.

SUMMARY OF THE INVENTION

Thus, the primary object of the present invention is to provide an image heating apparatus which is provided with an air blowing device facing the belt of the image heating apparatus to cool the belt, and is structured so that it can quickly reduce in temperature both its rotational heating member and belt.

According to an aspect of the present invention, there is provided an image heating apparatus comprising a heating rotatable member; a belt cooperating with said heating rotatable member to form a nip for heating an image on the recording material; a heating device for heating said heating rotatable member; a controller for controlling a temperature of said heating rotatable member at a first temperature when the recording material has a first thickness, and for controlling the temperature at a second temperature which is lower from the first temperature when the recording material has a second thickness which is smaller than the first thickness; an air feeding device for feeding air to said belt during an image heating operation; a moving mechanism for spacing said belt from said heating rotatable member; and an executing portion capable of executing an operation in a mode in which said air feeding device feeds the air into between said belt and said heating rotatable member while said belt is spaced from said heating rotatable member with said belt and said heating member being rotating, wherein when the recording material having the second thickness is fed following the recording material having the first thickness, said executing portion executes the operation in said mode after the recording material having the first thickness passes through the nip and before the recording material having the second thickness is fed into the nip.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the embodiments of the present invention are described in detail with reference to the appended drawings. The present invention is applicable to any image heating apparatus (device) as long as the apparatus (device) is structured so that the airflow generated by the air blowing device positioned on the pressure belt side can be made to cool both the rotational heating member and the pressure belt, or only the pressure belt, with the use of a mechanism for pivotally moving the belt, even if the apparatus is partially or entirely different in structure from the image heating apparatus in the following embodiments of the present invention.

The following embodiments of the present invention are described with reference to image heating apparatuses (device) which employ a combination of a heat applying belt (which hereafter will be referred to simply as a heat belt), and a pressure applying belt (which hereafter may be referred to simply as pressure belt). However, the present invention is also applicable to image heating apparatuses (devices) which employs a combination of a heat belt and a pressure applying roller (which hereafter may be referred to simply as a pressure roller), and image heating apparatuses (devices) which employ a heat roller and a pressure belt. Further, not only is the present invention applicable to image heating apparatuses (device) as a fixing device, but also is applicable to gloss altering apparatuses or the like which are independent from an image forming apparatus.

The image forming apparatuses in which the image heating apparatus (device) in accordance with the present invention is installable are not limited to those which employ an intermediary transfer belt. That is, the image heating apparatus (device) in accordance with the present invention is also installable in those which directly transfer a toner image onto a sheet of the recording medium, those which employ an intermediary transfer drum, those which employ a the recording medium conveying belt, or the like image forming apparatus. In the description of the image heating apparatuses (devices) in the following embodiments of the present invention, only the portions of the image forming apparatus, which relate to the primary sections of the apparatus, that is, the sections which relate to the formation and transfer of a toner image, are described. However, the present invention is also applicable to image forming apparatuses other than those in the following embodiments of the present invention. For example, it is also applicable to various printing machines, copying machines, facsimile machines, and the like, which are the combination of one of the image forming apparatuses in the following embodiments of the present invention, and additional devices, equipments, a case (container).

<Image Forming Apparatus>

Figure 1:
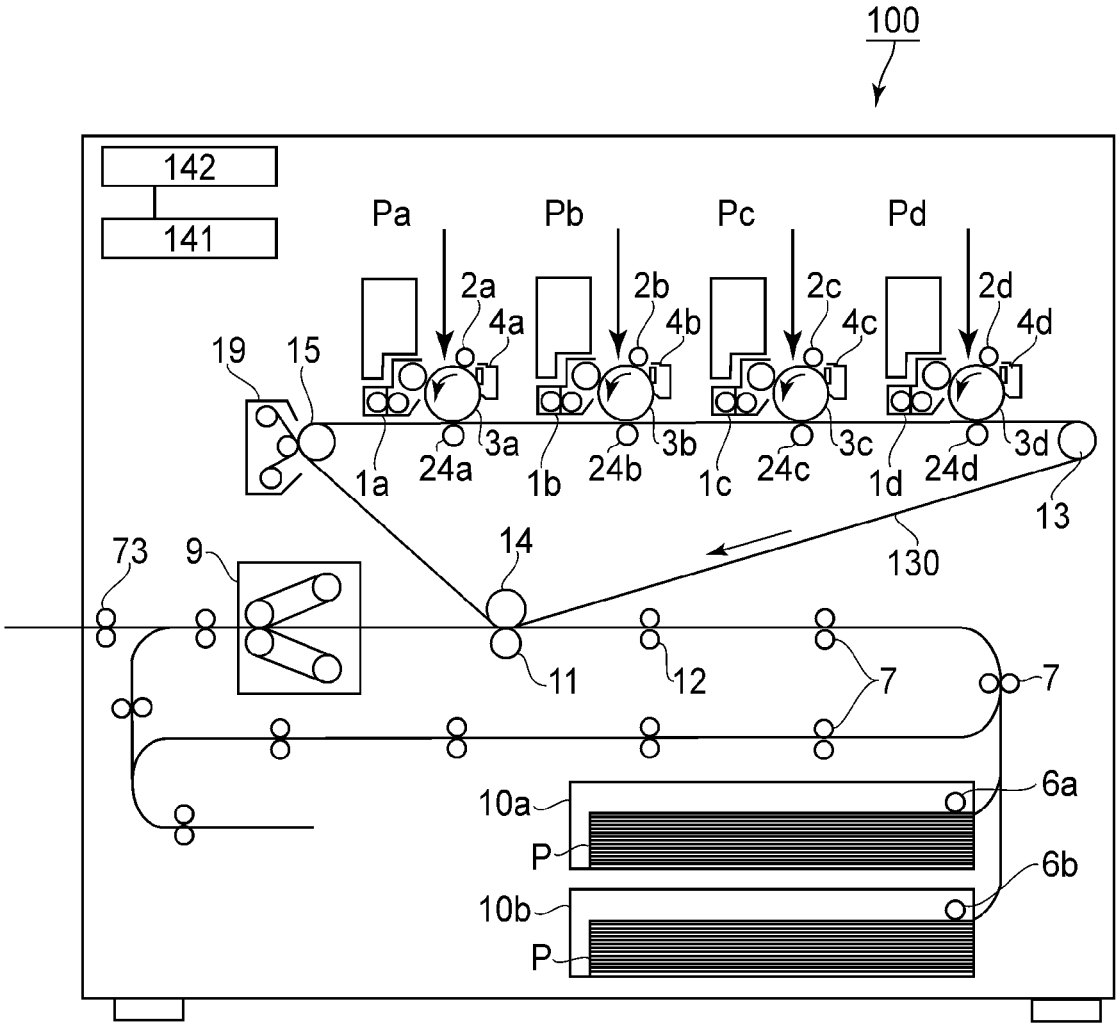
FIG. 1 is a drawing for illustrating the structure of a typical image forming apparatus to which the present invention is applicable.
Figure 2:
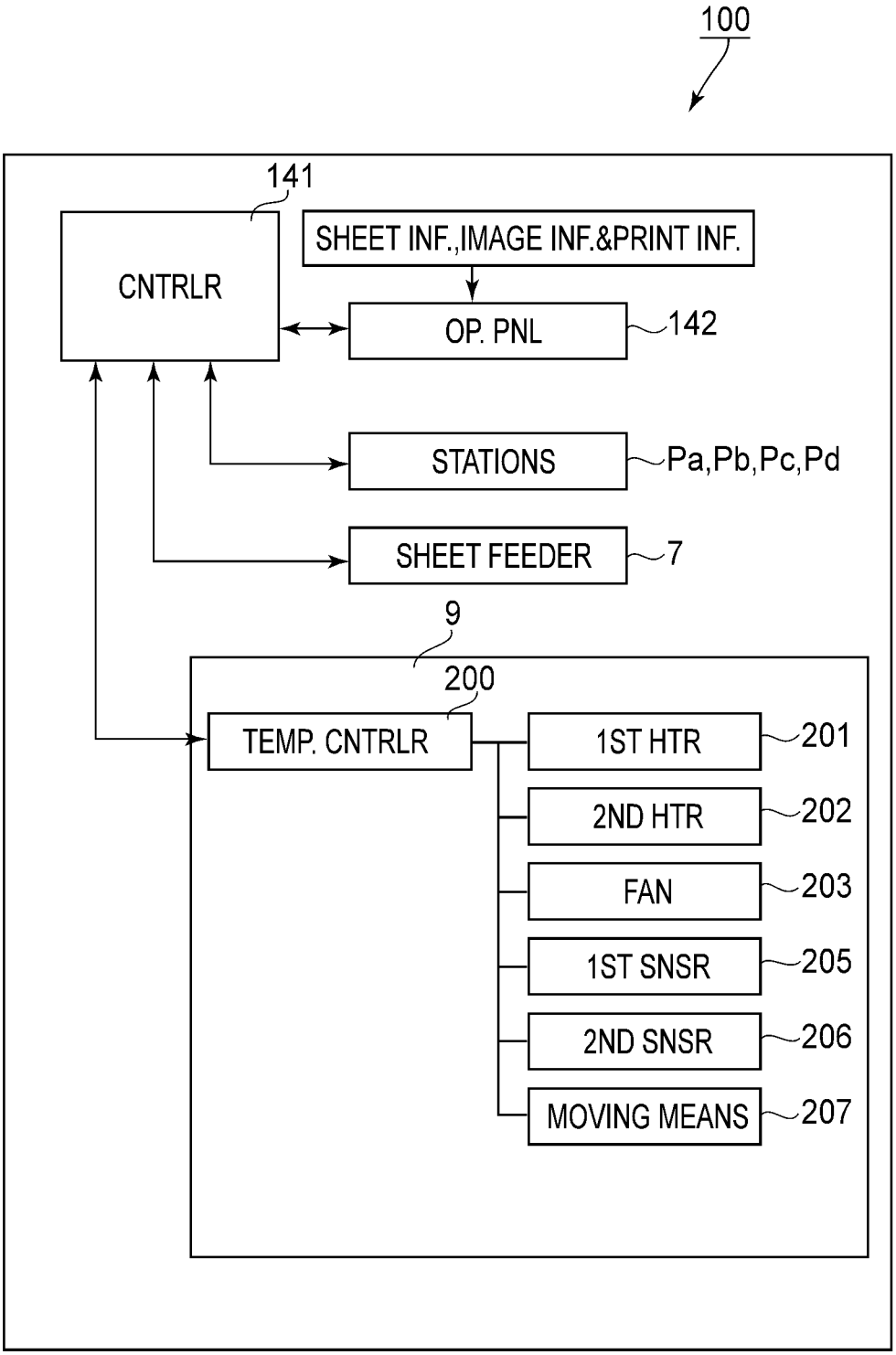
FIG. 2 is a block diagram of the control system of the image forming apparatus.

FIG. 1 is a drawing for illustrating the structure of a typical image forming apparatus to which the present invention is applicable. FIG. 2 is a block diagram of the control system of the image forming apparatus. Referring to FIG. 1, the image forming apparatus 100 has image formation stations Pa, Pb, Pc and Pd which form yellow, magenta, cyan and black monochromatic toner images, respectively, which are aligned in tandem in the recording medium conveyance direction, and an intermediary transferring member. That is, it is a full-color printer of the tandem type, and also, of the intermediary transfer type.

In the image formation station Pa, a yellow toner image is formed on a photosensitive drum 3*a*, and is transferred onto an intermediary transfer belt 130. In the image formation station Pb, a magenta toner image is formed on a photosensitive drum 3*b*, and is transferred onto the intermediary transfer belt 130. In the image formation station Pc, a cyan toner image is formed on a photosensitive drum 3*c*, and is transferred onto an intermediary transfer belt 130. In the image formation station Pd, a black toner image is formed on a photosensitive drum 3*d*, and is transferred onto the intermediary transfer belt 130.

A secondary transfer roller 11 forms a secondary transfer station T2, by being placed in contact with the intermediary transfer belt 130 which is backed up by a belt backing roller 14 from within the loop which the belt 130 forms. As a sheet P of the recording medium is pulled out of a recording medium cassette 10 (10*a* or 10*b*) while being separated from the rest of the sheets P in the cassette 10, it is sent to a pair of registration rollers 12, which conveys the sheet P to the secondary transfer station T2 with such a timing that the sheet P arrives at the secondary transfer station T2 at the same time as the toner image(s) on the intermediary transfer belt 130. In the secondary transfer station T2, the toner images and the sheet P are conveyed in layers while remaining pinched by the secondary transfer roller 11 and intermediary transfer belt 130. While the combination of the toner images, the sheet P is conveyed through the secondary transfer station T2, and a preset positive DC voltage is applied to the secondary transfer roller 11. Thus, a full-color toner image (made up of four monochromatic toner images different in color) is transferred (secondary transfer) from the intermediary transfer belt 130 onto the sheet P. A belt cleaning device 19 recovers the transfer residual toner, that is, the toner which failed to be transferred onto the sheet P, and therefore, remains on the intermediary transfer belt 130.

After the transfer of the four monochromatic toner images, different in color, onto the sheet P of the recording medium, the sheet P is separated from the intermediary transfer belt 130 with the utilization of the curvature of the portion of the intermediary transfer belt 130, which corresponds in position to the belt backing roller 14. Then, the sheet P is sent into a fixing device 9, which melts the toner by applying heat to the toner while applying pressure to the toner. Thus, the toner images are fixed to the sheet P. Thereafter, the sheet P is discharged from the main assembly of the image forming apparatus 100 by way of a pair of discharge rollers 73.

The image formation stations Pa, Pb, Pc and Pd are practically the same in structure, although they are different in the color (yellow, magenta, cyan and black) of the toner they use. Hereafter, therefore, only the image formation station Pa is described. The description of the image formation stations Pb, Pc and Pd is the same as that of the image formation station Pa except for the suffixes b, c and d which indicate to which image formation station P each component belongs.

The image formation station Pa comprises a photosensitive drum 3*a*, a charge roller 2*a*, an exposing device 5*a*, a developing device la, a transfer roller 24*a*, and a drum cleaning device 4*a*. The charge roller 2*a*, the exposing device 5*a*, the developing device 1*a*, the transfer roller 24*a*, and the drum cleaning device 4*a* are in the adjacencies of the peripheral surface of the photosensitive drum 3*a*. The photosensitive drum 3*a* has a negatively chargeable photosensitive layer. It rotates in the direction indicated by an arrow mark at a process speed of 200 mm/sec.

The charge roller 2*a* uniformly and negatively charges the peripheral surface of the photosensitive drum 3*a* to a preset level VD (which hereafter may be referred to as "dark potential level"). The exposing device 5*a* writes an electrostatic image of the image to be formed. More concretely, it scans the uniformly charged area of the peripheral surface of the photosensitive drum 3*a* with a beam of laser light it outputs while deflecting the beam with its rotational mirror. Thus, the exposed points of the uniformly charged area of the photosensitive drum 3*a* decrease in potential level to a level VL (which hereafter may be referred to as "light potential level"). Consequently, an electrostatic image of the image to be formed is effected on the peripheral surface of the photosensitive drum 3*a*. The developing device 1*a*develops the electrostatic image on the photosensitive drum 3*a*, into a visible image, that is, an image formed of toner, with the use of two-component developer made up of toner and carrier.

The transfer roller 24*a* forms, between the photosensitive drum 3*a* and intermediary transfer belt 130, a transfer station, in which the toner image is transferred onto the intermediary transfer belt 130. To the transfer roller 24*a*, a preset transfer voltage, which is opposite in polarity from the polarity to which toner is charged is applied. As the portion of the peripheral surface of the photosensitive drum 3*a*, on which toner is present, moves through the transfer station, the toner (which makes up visible image) is transferred onto the intermediary transfer belt 130. The drum cleaning device 4*a* recovers the transfer residual toner, that is, the toner which failed to be transferred from the photosensitive drum 3*a*, and therefore, remains on the photosensitive drum 3*a*.

The image forming apparatus 100 can continuously output prints by sequentially repeating the process of feeding a sheet of recording paper into the main assembly of the image forming apparatus 100, the process of forming an unfixed toner image, the process of fixing an unfixed toner image, and the process of discharging the sheet of the recording medium. It can output 80 full-color prints per minute when the recording medium is a sheet of ordinary paper, which is A4 in size.

Referring to FIG. 2, the image forming apparatus 100 has: a control section 141 made up of a microcomputer; and a control panel which functions as an interface for a user to access the image forming apparatus 100. The control section 141 oversees the image forming operation of the image forming apparatus 100 while observing and controlling the operation of each of the various sections of the image forming apparatus 100. The control panel 142 is the section through which basic information of a print job (information, such as basis weight of the recording medium, the density of the image to be formed, the number of prints to be made, etc.), and/or the detailed setting for a so-called "serial job", that is, a printing job made up of a serial combination of smaller jobs which are different in the recording-medium type.

<Fixing Device>

Figure 3:
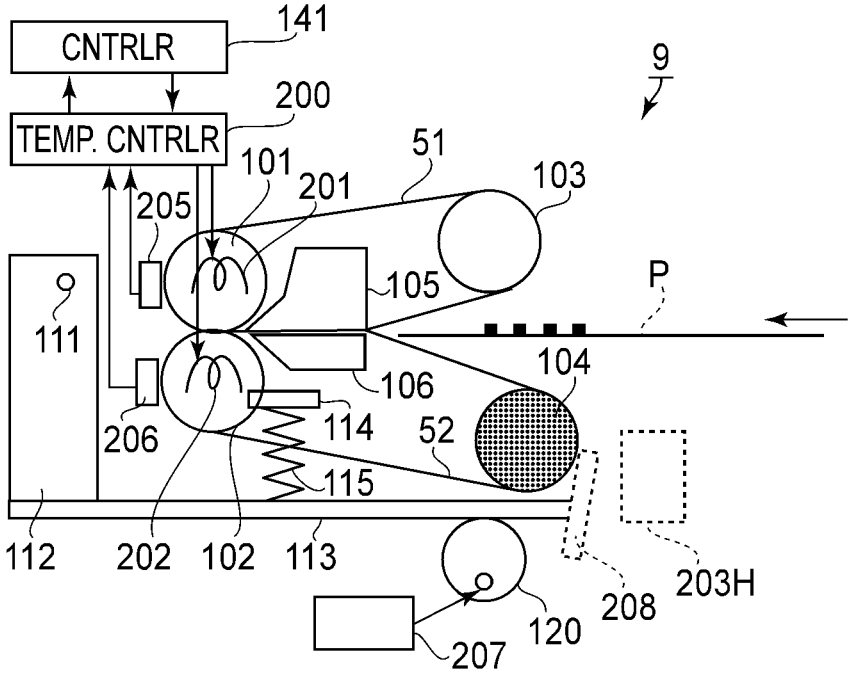
FIG. 3 is a drawing for illustrating the structure of the fixing device.
Figure 3:
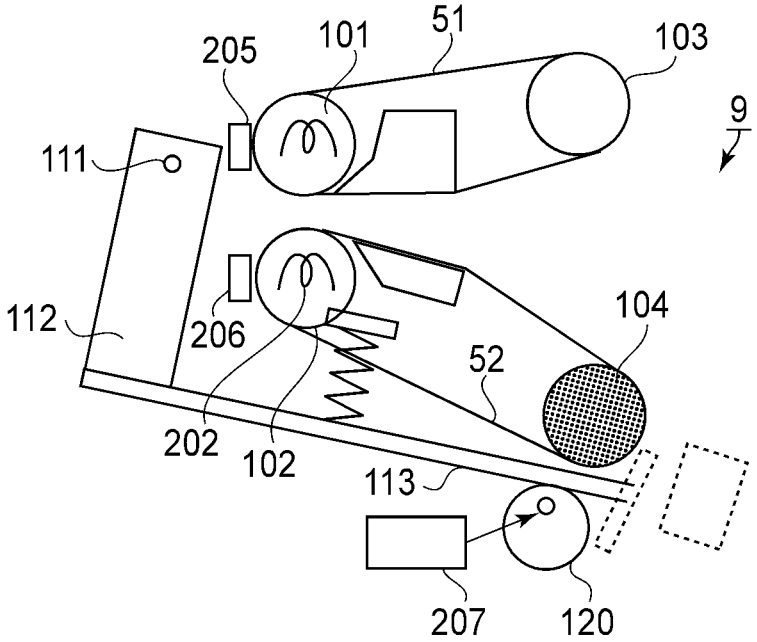

FIGS. 3(*a*) and 3(*b*) are drawings illustrating the structure of the fixing device 9. FIG. 3(*a*) shows the state of the fixing device 9, in which the pressure belt is in contact with the heat belt (fixation belt). FIG. 3(*b*) shows the state of the fixing device, in which a space is present between the heat belt (fixation belt) and pressure belt.

Referring to FIG. 3(*a*), the fixing device 9 is made up of a fixation belt 51, and a pressure belt 52, which is pressed upon the fixation belt 51 to form a heating nip N. The fixation belt 51 is controlled in temperature so that its temperature remains above the melting point of the toner. A sheet P of the recording medium, on which toner image(s) is present, is conveyed through the heating nip N while remaining pinched by the fixation belt 51 and the pressure belt 52. Consequently, the toner image(s) on the sheet P is fixed to the sheet P by the heat and pressure applied to the sheet P and the toner image(s) thereon, by the fixing device 9. The pressure belt 52, which is an example of an endless belt, can form, between itself and fixation belt 51, the heating hip N for heating the sheet P and the toner image(s) thereon. The fixation belt 51 is positioned above the pressure belt 52, and its temperature is kept at a higher target level than that for the pressure belt 52.

The fixation belt 51 and pressure belt 52 of the fixing device 9 form the heating nip N, which is rectangular in shape, and the widthwise direction of which is parallel to the direction in which a sheet P of the recording medium is conveyed. A combination of the fixation belt (heating belt) driving roller 101, and a stay 105, which is in the form of a pad, and a combination of a pressure roller 102 and a pressure pad 106, sandwich the portion of the fixation belt 51, and the portion of the pressure belt 52, which are within the heating nip N. A sheet P of the recording medium is conveyed through the fixing device 9 in the right-to-left direction, while being subjected to heat and pressure, in the heating nip N. Consequently, the toner image(s) on the sheet P is fixed to the surface of the sheet P.

The fixation belt 51 is supported by the fixation belt driving roller 101, and a tension roller 103 which functions as a roller for providing the fixation belt 51 with a preset amount of tension, by being wrapped around the two rollers 101 and 103. The substrate of the fixation belt 51 is an endless metallic belt formed of nickel, and is 50 μm in thickness, 380 mm in width, and 160 mm in length. The substrate is coated with a layer of silicon rubber, which is 400 μm in thickness. The silicon rubber layer is covered with a surface layer, which is made of PFA tube and is 40 μm in thickness.

The fixation belt driving roller 101 is a hollow roller which is made of a piece of stainless steel pipe. It is 20 mm in external diameter. The tension roller 103 also is a hollow roller which is made of a piece of stainless steel pipe. It is 20 mm in external diameter, and 18 mm in internal diameter. Its lengthwise end portions are under the pressure from a pair of unshown tension springs, providing thereby the fixation belt 51 with a preset amount of tension.

There is a pressure pad 105 on the inward side of the loop which the fixation belt 51 forms. The pressure pad 105 is formed of stainless steel, and is positioned on the entrance side of the heating nip N so that it opposes the pressure pad 106. The pressure pad 105 doubles as a heat storing member for preventing the heating nip N from reducing in temperature when a sheet P of the recording medium is conveyed through the heating nip N.

The pressure belt 52 is supported by the pressure roller 102, and a tension roller 104 which is given the function of providing the pressure belt 52 with a preset amount of tension, by being wrapped around the two rollers 102 and 104. The substrate of the pressure belt 52 is an endless metallic belt formed of nickel, and is 50 μm in thickness, 380 mm in width, and 172 mm in length. The substrate is coated with a layer of silicon rubber, which is 350 μm in thickness. The silicon rubber layer is covered with a surface layer, which is made of PFA tube and is 40 μm in thickness.

The pressure roller 102 is a hollow roller which is made of a piece of stainless steel pipe. It is 20 mm in external diameter. The tension roller 104 also is a hollow roller which is made of a piece of stainless steel pipe. It is 20 mm in external diameter, and 18 mm in internal diameter. Its lengthwise end portions are under the pressure from a pair of unshown tension springs, providing thereby the pressure belt 52 with a preset amount of tension. There is the pressure pad 106 on the inward side of the loop which the pressure belt 52 forms. The pressure pad 106 is formed of silicone rubber, and is on the entrance side of the heating nip N. Further, the pressure pad 106 is kept pressed upon the inward surface of the pressure belt 52 with the application of a total pressure of 400 N.

There is a first heating element 201 in the hollow of the fixation belt driving roller 101. The rated power of the first heating element 201 is 1,000 W. Further, there is a second heating element 202 in the hollow of the pressure roller 102, the rated power of the second heating element is also 1,000 W. The fixation belt driving roller 101 and pressure roller 102 are in connection with each other through a pair of gears attached, one for one, to one of the lengthwise ends of the roller 101 and the same lengthwise end of the roller 102. Thus, the two rollers 101 and 102 rotate with roughly the same peripheral velocity by being driving by an external force. Therefore, the fixation belt 51 and the pressure belt 52 circularly move with roughly the same speed whether they are kept in contact with each other, or kept separated from each other.

<Pressure Belt Pivoting Mechanism>

A pressure belt pivoting mechanism 207 can place the pressure belt 52 in contact with the fixation belt 51 or separate the pressure belt 52 from the fixation belt 51. The mechanism 207 is such a mechanism that can pivotally move the tension roller 104 (which supports pressure belt 52, on the recording medium entrance side of heating nip N) about an axis 111, which is on the recording medium exit side of the heating nip N.

The pressure belt 52, the pressure roller 102, the pressure pad 106, and the tension roller 104 are attached to a plate 113, which is pivotally movable about the axis 111. Thus, they make up a pressure application unit which can be pivotally moved, along with the plate 113, about the axis 111. Further, the fixing device 9 is provided with a pair of pressure application arms 112 and a pair of pivotally movable pressure application plates 113, the positions of which correspond to the lengthwise ends, one for one, of the pressure roller 102, are independently and pivotally movable about the axis 111. The pressure roller 102 and the pressure pad 106 are supported by a pressure application plate 114, and are kept pressed upward by a pair of compression springs 115.

The fixing device 9 is also provided with a pressure application cam 120, which is in contact with the bottom surface of the pivotally movable pressure application plate 113. Thus, as the pressure application cam 120 rotates, the plate 113 is moved upward or downward, causing the pressure belt 52 to be pressed upon the fixation belt 51 or to be separated from the belt 51. The pressure application cam 120 is driven by the pressure belt pivoting mechanism 207, thereby making the pressure belt 52 (supported by the pressure pad 106, and the tension roller 104) pivot upward or downward about the axis 111.

The control section 141 can press the pressure belt 52 upon the fixation belt 51, or separate the pressure belt 52 from the fixation belt 51. The amount of distance provided between the pressure belt 52 and fixation belt 51 is optional. The total amount of load applied between the fixation belt 51 and pressure belt 52 as the pressure belt 52 is pressed upon the fixation belt 51 is roughly 800 N (80 kgf). As the pressure belt 52 is pressed upon the fixation belt 51, the heating nip N is formed, which is rectangular, and the dimension of which in the recording medium conveyance direction is roughly 15 mm. The conventional objectives of the pressure belt pivoting mechanism 207 are to make it easier for a user to deal with paper jam or the like problems, to extend the fixation belt 51 in service life, to prevent the pressure belt 52 from increasing in temperature while no sheet of paper is conveyed through the heating nip N, or the like.

However, if the temperature of the pressure belt 52 is excessively high when the pressure belt 52 is pressed upon the fixation belt 51, the moisture in a sheet of coated paper evaporates into steam, and the steam breaks through the coated surface layer of the sheet and erupts from the sheet P. As the steam breaks through the coated surface layer, it disturbs the toner image(s) on the surface of the sheet P, causing a phenomenon called "blistering". Further, if the temperature of the pressure belt 52 is excessively high, the moisture in a sheet P of the recording medium evaporates into steam, and the steam reduces the amount of the friction between the pressure belt 52 and the bottom surface of the sheet P. The reduction in the amount of the friction between the pressure belt 52 and the bottom surface of the sheet P makes the pressure belt 52 and sheet P slip relative to each other, making it possible for the sheet P to be improperly conveyed. Further, if the steam attributable to the evaporation of the moisture in the sheet P settles between the fixation belt 51 and the image bearing surface of the sheet P, it is likely for the fixation belt 51 to float above the image bearing surface of the sheet P, and therefore, it is possible for the image forming apparatus 100 to output images which are nonuniform in gloss.

Therefore, the image forming apparatus 100 in this embodiment is controlled so that the temperature of the pressure belt 52 is kept substantially lower than that of the fixation belt 51. Further, while no sheet of the recording medium is conveyed, the pressure belt 52 is kept separated from the fixation belt 51 by the pressure belt pivoting mechanism 207 in order to prevent the fixation belt 51 from being reduced in temperature. Therefore, it is ensured that the fixing device 9 can satisfactorily fix the toner image(s) on the sheet P of the recording medium to the sheet P while minimizing the amount by which heat is applied to the sheet P.

<Temperature Control of Fixing Device>

Next, referring to FIG. 2 as well as FIG. 3, a temperature control section 200 adjusts the fixation belt 51 in surface temperature, by controlling the amount of electric power supplied to the first heating element 201 (heating device), based on the temperature of the fixation belt 51 detected by first temperature detection element 205, which is on the downstream side of the heating nip N and is in contact with the center of the fixation belt 51 in terms of the widthwise direction of the belt 51. Further, the temperature control section 200 adjusts the pressure belt 52 in surface temperature by controlling the amount of electric power supplied to the second heating element 202 (heating device), based on the temperature of the pressure belt 52 detected by the second temperature detection element 206, which is on the downstream side of the heating nip N and is in contact with the center of the pressure belt 52 in terms of the widthwise direction of the belt 51, and also, controls the air blowing fan 203. The first and second heating elements 201 and 202 in this embodiment are halogen lamps. However, they may be replaced with heat generating resistors, induction heating elements, or the like.

As a print job is started, the control section 141 selects a target temperature level for the temperature adjustment of the fixing device 9, based on the information of a sheet P of the recording medium inputted through the control panel 142, and makes the temperature control section 200 control the fixation belt 51 and the pressure belt 52 in temperature, based on the selected target temperature level. Table 1 is a target temperature table for the temperature control of the fixing device 9. It is to be used when the image on a sheet P of the recording medium is heated for fixation while the fixation belt 51 and pressure belt 52 are kept in contact with each other. That is, during an image forming operation, the heating device 9 and air blowing fan 203 are controlled so that the temperature of the fixation belt 51 and that of the pressure belt 52 remain at their target temperature levels, respectively.

TABLE 1

| | | Target Temp. | | Job Start Discriminating Temp. | |
|---|---|---|---|---|---|
| Materials | Basis Wt. (g/m^2) | Fixing Belt | Pressing Belt | Fixing Belt | Pressing Belt |
| Thick 2 | 181-256 | 190° C. | 100° C. | 190° C. | 100° C.-120° C. |
| Thick 1 | 106-180 | 185° C. | 100° C. | 185° C. | 100° C.-120° C. |
| Plain 2 | 91-105 | 180° C. | 100° C. | 180° C. | 100° C.-120° C. |
| Plain 1 | 64-90 | 175° C. | 100° C. | 175° C. | 100° C.-110° C. |
| Thin | 52-63 | 165° C. | 100° C. | 165° C. | 100° C.-110° C. |
| Coated | 106-180 | 170° C. | 100° C. | 170° C. | 100° C.-110° C. |

Referring to Table 1, the control section 141 controls in temperature the fixation belt 51 and the pressure belt 52 by selecting a proper target level for each belt, from among the several levels, according to the recording medium type (basis weight, surface properties, etc.). For paper which is not coated, for example, ordinary printing paper or the like, the target temperature is set to a level which can satisfy both the conveyablility of the recording medium (wrinkle prevention, ease of separation, etc.) and image quality (fixation, toner-offset, surface gloss, etc.). In other words, the greater in basis weigh the recording medium, the higher the level to which the target temperature is set. In comparison, for coated paper, that is, paper, the surface layer of which is formed of resin, the target temperature is set to a level which is specific for satisfying not only the basis requirements (conveyability, image quality), but also, for the prevention of the occurrence of such problems as the recording medium conveyance error and formation of defective images that are peculiar to coated paper. That is, in order to prevent the amount of heat applied to the recording medium to heat the image on the recording medium, from becoming excessive, the target temperature for the pressure belt 52 is set lower than that for the fixation belt 51 as shown in Table 1. In order to keep the temperature of the pressure belt 52 at one of its target levels, the control section 141 controls the air blowing fan 203 according to the selected temperature level for the pressure belt 52. That is, as the temperature of the pressure belt 52 becomes higher than the selected level, the control section 141 operates the air blowing fan 203, and as the temperature of the pressure belt 52 becomes lower than the selected level, the control section 141 stops the air blowing fan 203.

From the standpoint of both the conveyability of the recording medium, and image quality, the target temperature for the fixation belt 51 and the job start temperature are set so that the greater in basis weight a sheet P of the recording medium, the higher the level to which the target temperature is set.

Basically, the target temperature for the pressure belt 52 is set to 100° C. regardless of the recording medium type. However, as a substantial number of sheets of the recording medium are continuously conveyed through the fixing device 9, the pressure belt 52 increases in temperature, because the fixation belt 51 comes into contact with the pressure belt 52 during the sheet intervals. Therefore, a print job interruption temperature is provided for the pressure belt 52. If the temperature of the pressure belt 52 reaches the print job interruption temperature, the ongoing image forming operation is interrupted to reduce the pressure belt 52 in temperature, and the image forming apparatus 100 is idled until the pressure belt temperature falls below the print job interruption level.

Referring to Table 1, in an image forming operation in which the recording medium is an ordinary paper 1 (which is small in basis weight) or thin paper, the heat of the pressure belt 52 is likely to be transmitted to the toner layer through a sheet P of the recording medium, and excessively melt the toner layer, because of the thinness of the recording medium. As the toner layer excessively melts, the melted toner is likely to flow along the microscopic hills and valleys of the surface of the recording medium, making thereby the toner image nonuniform in density as the toner image becomes fixed. Therefore, for ordinary paper 1 or thin paper the print job interruption temperature is set to 110° C. Further, as the toner layer on the paper whose surface has numerous microscopic hills and valleys is excessively melted, the toner which is on the microscopic hill portions of the paper flows down to microscopic valley portions of the paper, because the excessively melted toner is very low in viscosity. Consequently, the toner image becomes conspicuously nonuniform in density and gloss, compared to a toner image, the portions of which on the microscopic hills of the sheet of the recording medium are the same in the amount of the toner as the portions of which in the microscopic valleys of the sheet of the recording medium. Therefore, for coated paper, the print interruption temperature for the pressure belt 52 is set to 110° C., in order to prevent the occurrence of the above described blistering. For recording media other than coated paper, the print interruption temperature for the pressure belt 52 is set to 120° C. in order to prioritize the conveyability of the recording medium (wrinkling prevention, ease of separation).

TABLE 2

| Target temperature | |
|---|---|
| Fixing roller | Pressing roller |
| 180° C. | 100° C. |

Referring to Table 2, the default setting for the standby target temperature is 180° C. for the fixation belt 51, and 100° C. for the pressure belt 52, in order to make it possible to immediately (without any waiting period) start a pending image forming operation when ordinary paper 2, which is more frequently used than the other type of recording medium, is used as the recording medium. Incidentally, the default setting for the standby target temperature may be named as "target temperature level for default paper", and displayed as such on the display of the control panel 142.

The fixing device 9 is provided with multiple levels of target temperature. Therefore, each time it is switched in the target temperature, a waiting period occurs. The print start temperature is affected by the type and basis weight of the recording medium. Thus, as the recording medium is switched in type and/or basis weight, the fixation belt 51 and pressure belt 52 have to be heated or cooled so that their temperatures settle at their print start temperatures.

In particular, in a case where the fixing device 9 is large in thermal capacity, it takes a substantial length of time for the fixing device 9 to be cooled. Thus, when it becomes necessary for the device 9 to be cooled, a substantial length of waiting time is required after the switching of the target temperature. An image heating device for a high-speed image forming apparatus is structured to be large in thermal capacity in order to be prevented from decreasing in temperature while a substantial number of sheets of the recording medium are continuously conveyed through the fixing device. Therefore, if the new target temperature level is lower than the immediately preceding target temperature level, it takes more time for the fixing device to reach the new target temperature level, affecting thereby the image forming apparatus 100 in overall productivity, than if the new target temperature level is higher than the immediately preceding target temperature level.

For example, in a case where the fixing device 9 is switched in target temperature to the level for thin paper from the standby period level shown in Table 2, it takes a substantial length of time for the temperatures of the fixation belt 51 and the pressure belt 52 to settle at their new target temperature levels. In other words, a substantial length of downtime occurs, and therefore, the image forming apparatus 100 decreases in productivity. Further, in the case of a "serial job", that is, a job in which an image formation sequence in which a substantial number of sheets of thin paper are continuously conveyed, and an image formation sequence in which a substantial number of sheets of thick paper are continuously conveyed are alternately carried out, the downtime for cooling occurs each time the image forming apparatus 100 is switched in image formation sequence (the recording medium is switched from thick paper to thin paper). Therefore, in the case of a "serial job", the image forming apparatus 100 is significantly lower in productivity than in a case of a job in which only the ordinary paper 2 is used as the recording medium. The frequent occurrence of the downtime is not desirable from the standpoint of usability.

One of the conventional methods for cooling the fixation belt 51 is to press the pressure belt 52 upon the fixation belt 51.

However, in a case where an image formation sequence in which a substantially number of sheets of thick paper are continuously conveyed is replaced with an image formation sequence in which a substantial number of sheets of thin paper are continuously conveyed, in a "serial job", for example, it is necessary to cool both the fixation belt 51 and pressure belt 52 as shown in Table 2. When the recording medium is thick paper 2, the target temperature for the fixation belt 51 is 190° C. (first level), whereas when the recording medium is thin paper 1, it is 165° C. (second level, which is lower than first level). In a situation such as the above-described one, the conventional method is effective as the method for quickly lowering the temperature of the fixation belt 51. However, the conventional method increases the temperature of the pressure belt 52 as well. Thus, the overall length of time required to reduce in temperature both the fixation belt 51 and pressure belt 52 to their target levels is rather long. In recent years, from the standpoint of reducing energy consumption, it has been desired to reduce the amount of toner consumption by an image forming apparatus as much as possible while ensuring that image quality is maintained at a conventional level or higher. One of the methods for maintaining image quality while reducing the amount of toner consumption compared to the conventional method is to increase toner in pigment ratio. Because of the recent trend in which it is desired to reduce an image forming apparatus in toner consumption, it has become very important to control the fixation belt 51 and pressure belt 52 in temperature, in particular, to prevent the pressure belt 52 from excessively increasing in temperature. Further, from the standpoint of preventing the problem attributable to the excessive melting of the toner layer, it has become very important to prevent the pressure belt 52 from excessively increasing in temperature, in order to prevent the toner layer from being supplied with an excessive amount of heat from the portions of the pressure belt 52, which are outside the recording medium path in terms of the lengthwise direction of the belt 52.

In this embodiment, therefore, air is blown upon the pressure belt 52 during an image forming operation. Further, while the fixation belt 51 and pressure belt 52 are changed in temperature, air is blown into the space between the fixation belt 51 and pressure belt 52. That is, the fixing device 9 is provided with an air blowing device for cooling the belts 51 and 52. Therefore, both the rotational heating members and belts can be quickly reduced in temperature immediately after the switching of the target temperature for the belts 51 and 52.

<Embodiment 1>

Figure 4:
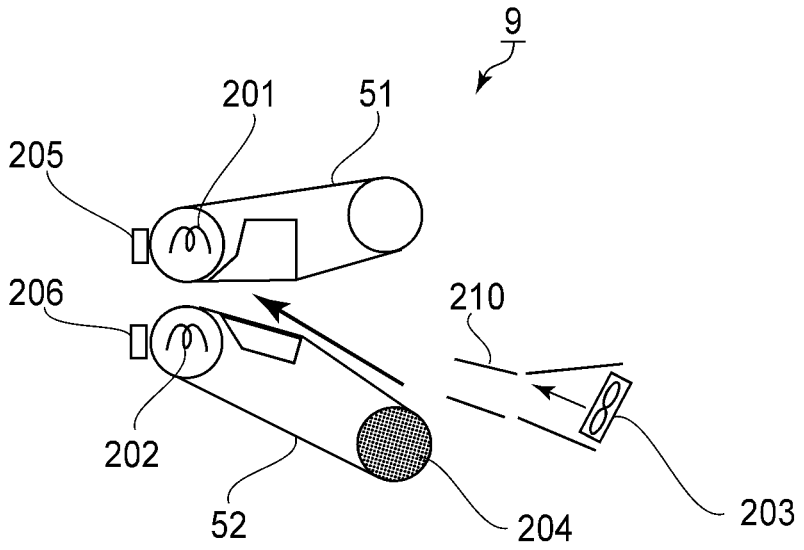
FIG. 4 is a drawing for illustrating the structure of the belt cooling system in the first embodiment of the present invention.
Figure 4:
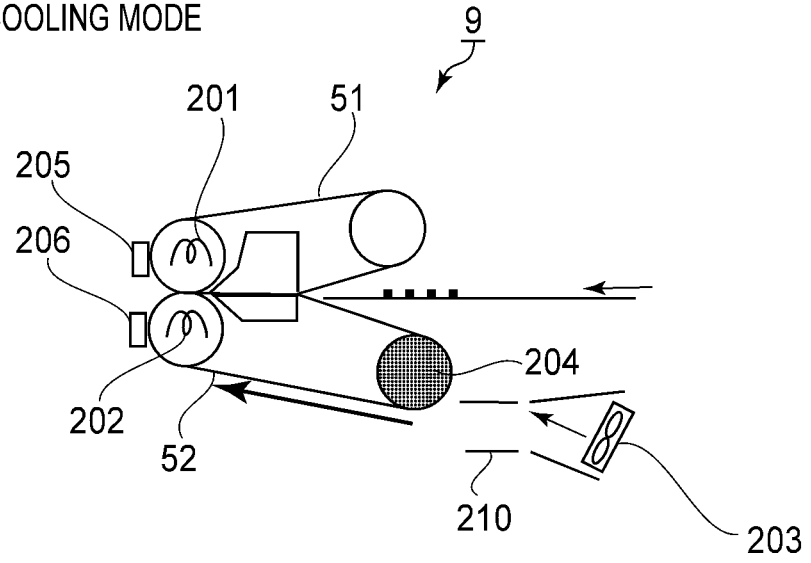
Figure 5:
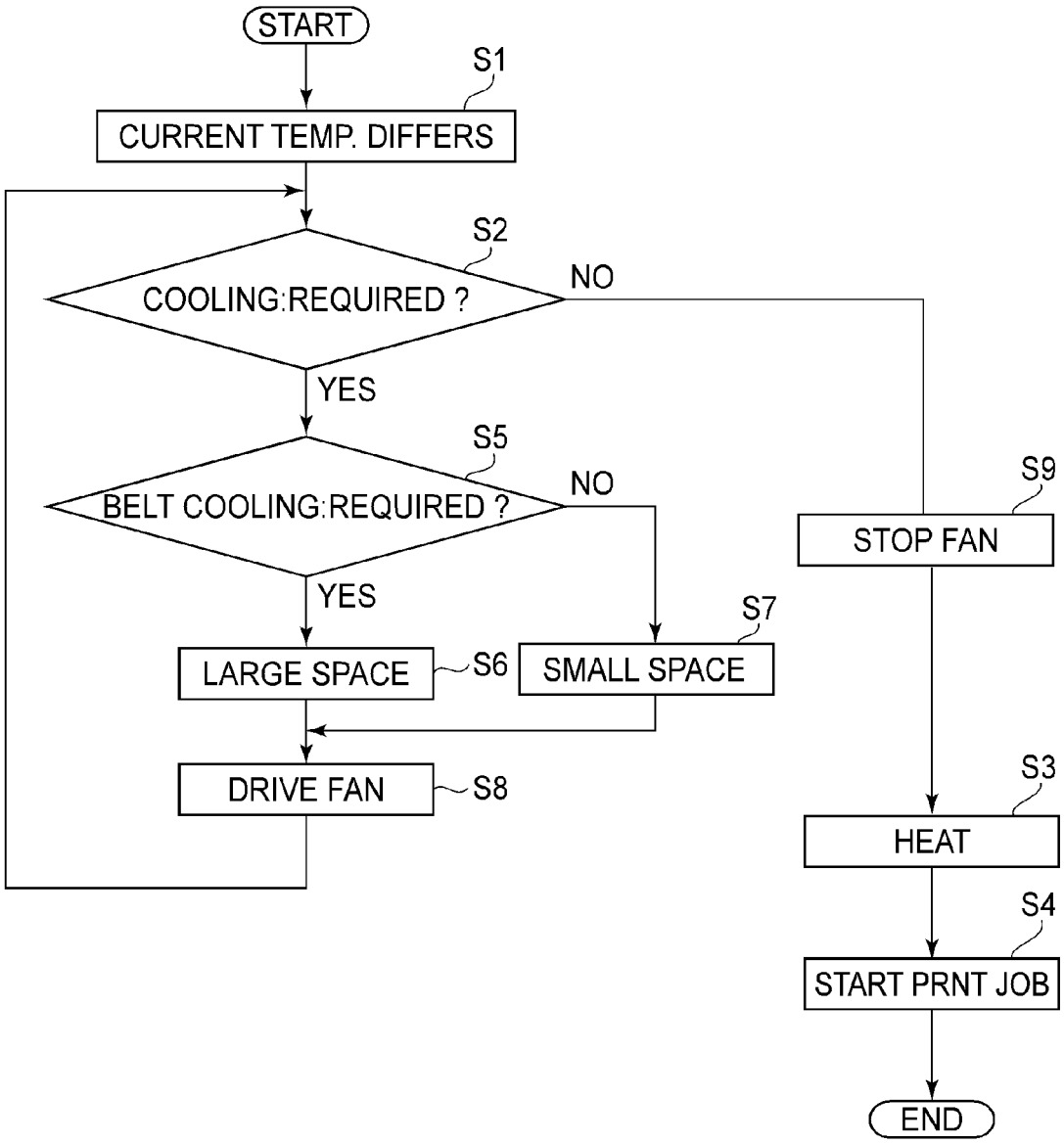
FIG. 5 is a flowchart of the control sequence for the belt cooling system in the first embodiment.
Figure 6:
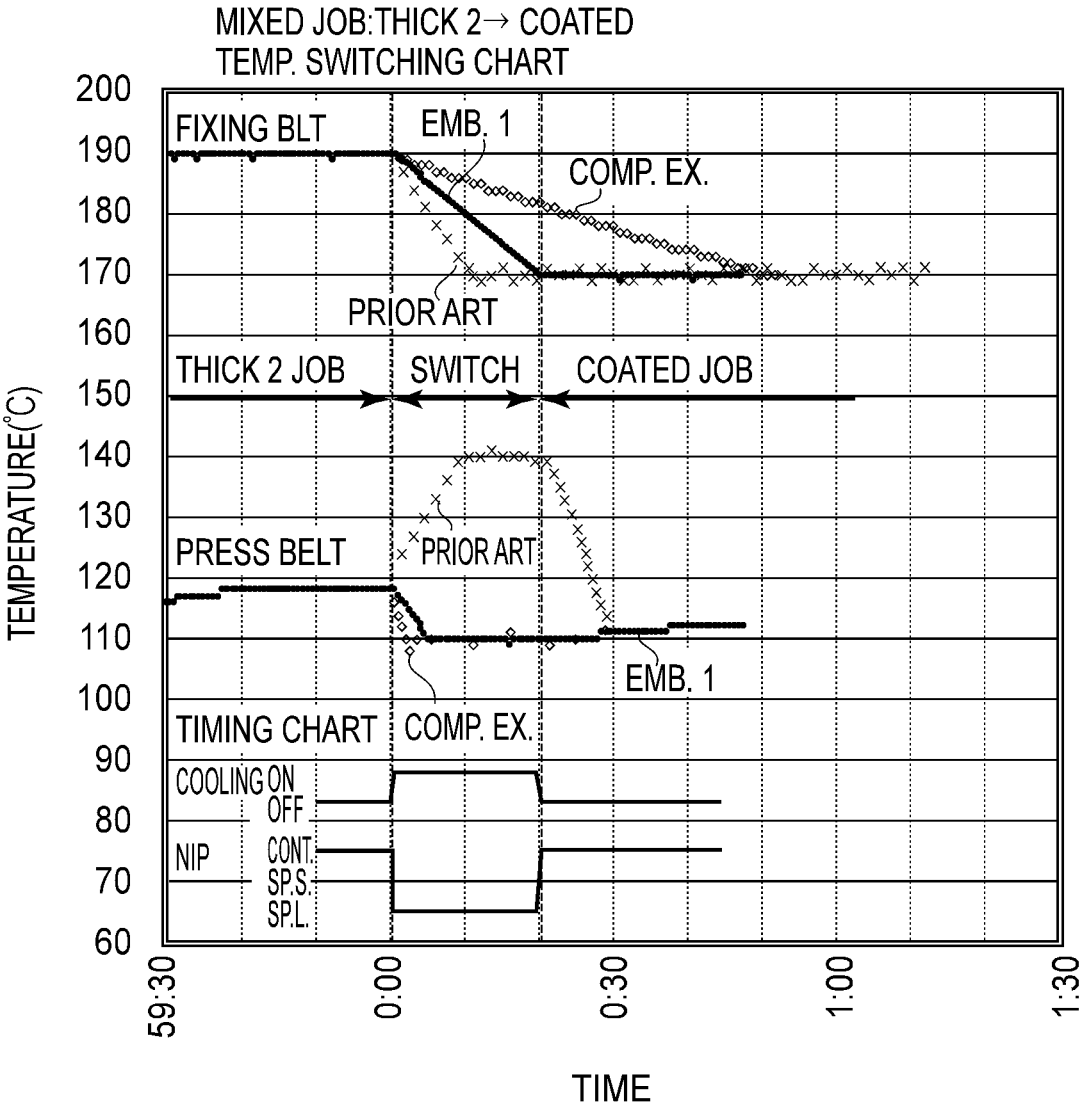
FIG. 6 is a drawing for describing the difference in terms of cooling performance (changes in temperature of fixation belt and pressure belt) among the image heating device in the first embodiment, comparative image heating device, and conventional image heating device, which occurred as recording medium was switched from thick paper (cardboard) to thin paper (coated paper).

FIG. 4 is a drawing for illustrating the structure of the belt cooling system in the first embodiment of the present invention. FIG. 5 is a flowchart of the operational sequence for controlling the fixation belt 51 and pressure belt 52 in the first embodiment. FIG. 6 is a drawing for describing how the fixation belt 51 and pressure belt 52 are cooled after the recording medium is switched from thick paper to thin paper.

Referring to FIG. 4, the air blowing fan 203, which is an example of an air blowing device, is on the pressure belt side of the recording medium passage of the heating nip N. In terms of the recording medium conveyance direction, the air blowing device is on the upstream side of the heating nip N as shown in FIG. 4. Moreover, the position of the air blowing device corresponds to the upstream side of the pressure belt in terms of the recording medium conveyance direction. The air blowing fan 203 can be made to cool, with air, the portion of the pressure belt 52, which is facing opposite from the fixation belt 51, or the portion of the pressure belt 52, which is facing the fixation belt 51, as the tension roller 104 is pivotally moved about the axis 111. More concretely, as the pressure belt pivoting mechanism 207 separates the pressure belt 52 from the fixation belt 51, the airflow generated by the air blowing fan 203 moves along the upstream portion of the top portion of the pressure belt 52, which is on the upstream side of the heating nip N, and reaches fixation belt 51. That is, the air blowing device sends air through the space between the fixation belt 51 and pressure belt 52. On the other hand, as the pressure belt pivoting mechanism 207 places the pressure belt 52 in contact with the fixation belt 51, the airflow which is generated by the air blowing fan 203 and would have reached the fixation belt 51, is blocked by the pressure belt 52. Thus, the air blowing fan 203 sends air only to the pressure belt 52. Further, the fixing device 9 in this embodiment is provided with a member 210 for changing the direction in which the airflow generated by the air blowing fan 203 moves. That is, the member 210 can direct the airflow generated by the air blowing fan 203 toward the pressure belt 52, or the space between the fixation belt 51 and pressure belt 52.

As described above, the fixing device 9 in this embodiment is structured so that (a) not only can the pressure belt 52 be changed in attitude by the pressure belt pivoting mechanism 207, but also, (b) the airflow generated by the air blowing fan 203 can be changed in direction by an airflow direction changing member 210, that is, a member for changing the direction of the airflow.

The control section 141, which is an example of a controlling means, functions as the section for operating the fixing device 9 in a cooling mode (first cooling mode) in which both the fixation belt 51 and pressure belt 52 are cooled. Further, the control section 141 functions also as the section for operating the fixing device 9 in a cooling mode (second cooling mode) in which only the pressure belt 52 is cooled. In this embodiment, as the target temperature for the fixation belt 51 is lowered, the control section 141 operates the fixing device 9 in the first cooling mode first, and then, operates the fixing device 9 in the second cooling mode.

Referring to FIG. 4(*a*), in the first cooling mode, the pressure belt 52 is separated from the fixation belt 51 in order to make the airflow generated by the air blowing fan 203 to be guided to the fixation belt 51 by the upwardly facing portion of the pressure belt 52, so that both the fixation belt 51 and pressure belt 52 are cooled. That is, in the first cooling mode, air is blown through the space between the fixation belt 51 and pressure belt 52 by the air blowing fan 203. More concretely, the airflow generated by the air blowing fan 203 flows along the portion of the pressure belt 52, which faces toward the fixation belt 51, and moves through the space between the fixation belt 51 and pressure belt 52.

Next, referring to FIG. 4(*b*), in the second cooling mode, the distance by which the pressure belt 52 is separated from the fixation belt 51 is made smaller than that in the first cooling mode, so that the pressure belt 52 becomes the primary object to be cooled by the airflow generated by the air blowing fan 203.

In the first embodiment, the object to which air is sent by the air blowing fan 203 is changed by changing the position of the tension roller 104 (attitude of pressure belt 52) with the use of the pressure belt pivoting mechanism 207. That is, as the mechanism 207 separates the pressure belt 52 from the fixation belt 51, it becomes possible for the air blowing fan 203 to sent air to the space between the fixation belt 51 and pressure belt 52.

Thereafter, the control section 141 controls the movement of the airflow direction changing member 210. That is, the control section 141 controls the airflow direction changing member 210 in such a manner that as the pressure belt 52 is separated from the fixation belt 51, the airflow is directed toward the space between the fixation belt 51 and pressure belt 52 by the member 210.

Next, referring to FIG. 5 along with FIG. 4, if the target temperature for the pressure belt 52 after the switching of the recording medium is different from the actually measured current temperature of the pressure belt 52 (S1), the control section 141 decides whether it is necessary to cool the pressure belt 52 or not (S2). If it is unnecessary to cool the pressure belt 52 (No in S2), the control section 141 does not activate the air blowing fan 203 (S9), and controls the temperature control section 200 to activate the first heating element 201 and second heating element 202 (S3). Then, as soon as the temperature of the fixation belt 51 and the temperature of the pressure belt 52 reach their target level, the control section 141 makes the image forming apparatus 100 start a printing job (S4). This is a temperature increasing process that does not require cooling. Therefore, it takes a relatively short length of time to start the job.

If it is necessary to cool the pressure belt 52 (Yes in S2), the control section 141 decides whether it is necessary to cool the fixation belt 51 (S5).

If it is necessary to cool the fixation belt 51 (Yes in S5), the control section 141 pivotally moves the tension roller 104 of the pressure belt 52 about the axis 111 to change the pressure belt 52 in attitude so that a space large enough for the airflow generated by the air blowing fan 203 to flow through is created between the fixation belt 51 and pressure belt 52 as shown in FIG. 4(*a*) (S6). Then, the control section 141 turns on the air blowing fan 203 (S8) to simultaneously cool both the fixation belt 51 and pressure belt 52. That is, the pressure belt 52 is kept separated from the fixation belt 51 (presence of large distance between two belts 51 and 52), and the airflow generated by the air blowing fan 203 moves between the fixation belt 51 and pressure belt 52.

As the fixation belt 51 is cooled enough, that is, it becomes unnecessary to cool the fixation belt 51 (No in S5), the control section 141 pivots the pressure belt 52 about the axis 111 toward the fixation belt 51, and stops the pressure belt 52 right before the pressure belt 52 comes into contact with the fixation belt 51, as shown in FIG. 4(*b*) so that the pressure belt 52 is prevented from being directly heated by the fixation belt 51 (S7). Then, the control section 141 cools only the pressure belt 52 by the air blowing fan 203 while keeping the pressure belt 52 separated from the fixation belt 51 by such a distance (small distance) that can prevent the pressure belt 52 from being heated by the fixation belt 51 (S8).

Then, as the fixation belt 51 is cooled enough, that is, as it becomes unnecessary to cool the pressure belt 52 (No in S2), the control section 141 stops sending air to the pressure belt 52 (S9), and goes back to the normal temperature control process (S3). Then, it makes the image forming apparatus 100 start the print job (S4).

The first embodiment is described with reference to a "serial job", in which a substantial number of prints are continuously outputted with the use of sheets of thick paper, and then, the recording medium is switched to coated paper. Referring to Table 1, the target temperatures for thick paper 2 were 190° C./118° C. (fixation belt/pressure belt). However, as the sheets of thick paper were continuously conveyed through the fixing device 9, the pressure belt 52 increased in temperature.

In the case of the fixing device in the first embodiment, the temperatures of the fixation belt 51 and pressure belt 52 right after 200 sheets of thick paper 2 were continuously conveyed through the fixing device 9 were 190° C/118° C. (fixation belt/pressure belt). Referring to Table 1, when the recording medium is coated paper, the target temperatures for the fixation belt 51 and pressure belt 52 are 170° C/110° C. (fixation belt/pressure belt). Therefore, both the fixation belt 51 and pressure belt 52 had to be cooled before it became possible for coated paper to be used as the recording medium.

In the experiment carried out to test the above described fixing apparatus in the first embodiment, a substantial number of sheets of thick paper 2 were continuously conveyed through the fixing device 9 up to a point in time of 0 minute 0 second as indicated by round black dots (bold line) in FIG. 6. Then, both the fixation belt 51 and pressure belt 52 began to be cooled at 0 minute 0 second, with the presence of a space between the fixation belt 51 and pressure belt 52 as shown in FIG. 4(*a*). The temperature of the fixation belt 51 reduced to a target level of 170° C. with the elapse of 21 seconds. Then, the pressure belt 52 was pivotally moved back toward the fixation belt 51 until the distance between the fixation belt 51 and pressure belt 52 became the preset minimum, as shown in FIG. 4(*b*), and the cooling of the pressure belt 52 was immediately started. At this point in time, however, the temperature of the pressure belt 52 had already reduced to 110° C. Therefore, the image forming operation which uses sheets of coated paper was started at the same time as the temperature of the fixation belt 51 came down to 170° C.

In this experiment, the conventional method for cooling the fixation belt 51 and pressure belt 52 was also studied. That is, the temperature of the fixation belt 51 was reduced to 170° C. while the pressure belt 52 was kept pressed upon the fixation belt 51. Then, the pressure belt 52 was separated from the fixation belt 51, and the temperature of the pressure belt 52 was reduced to its target level of 110° C.

The result of the conventional method is indicated by multiplication signs in FIG. 6. In the case of the conventional method, a substantial number of sheets of thick paper 2 were continuously conveyed through the fixing device 9 up to 0 minute 0 second, and then, the air blowing fan 203 was activated at 0 minute 0 second while the pressure belt 52 was kept in contact with the fixation belt 51. Thus, heat was removed from the fixation belt 51 by the pressure belt 52 which was being cooled while remaining in contact with the fixation belt 51. The temperature of the fixation belt 51 reduced to its target level of 170° C. in 11 seconds. However, while the fixation belt 51 was cooled, the pressure belt 52 was kept in contact with the fixation belt 51, being thereby increased in temperature to 140° C. Consequently, it took additional 20 seconds to reduce the temperature of the pressure belt 52 to its target level. In other words, a total downtime of 30 seconds was necessary to ready the fixing device 9 for fixation.

If the recording medium is switched from thick paper to thin paper immediately after a substantial number of sheets of thick paper are continuously conveyed through the fixing device 9, it is necessary to cool both the fixation belt 51 and pressure belt 52.

If the conventional method is used in this situation, the pressure belt 52 is increased in temperature while the fixation belt 51 is cooled by the pressure belt 52 which is kept pressed upon the fixation belt 51. Thus, the amount of time it takes for the temperature of the pressure belt 52 to reach its target level becomes longer, even though the conventional method reduces the amount of time it takes to cool the fixation belt 51.

In this experiment, a comparative method for cooling the fixation belt 51 and pressure belt 52 was studied. In the case of the comparative method, the pressure belt 52 was cooled while it was kept separated by a minute distance from the fixation belt 51. In other words, the fixation belt 51 was naturally cooled through the heat radiation therefrom, for the following reason. That is, in the case of the comparative method, only the pressure belt 52 is cooled, with the presence of a minutes distance between the fixation belt 51 and pressure belt 52. However, the fixation belt 51 is higher in temperature than the pressure belt 52. Thus, as the supply of electric power to the first heating element 201 is stopped, the fixation belt 51 relatively quickly reduces in temperature.

The result of the usage of the conventional method is indicated by rhombic signs in FIG. 6. In the case of the comparative method, a substantial number of sheets of thick paper 2 were continuously conveyed through the fixing device 9 from 59 minute 30 second to 0 minute 0 second. Then, the air blowing fan 203 was activated at 0 minute 0 second, to remove heat only from the pressure belt 52 while keeping a small distance between the fixation belt 51 and pressure belt 52 as shown in FIG. 4(*b*). In this case, it took only three seconds for the temperature of the pressure belt 52 to reduced to its target level of 110° C. However, it took 43 seconds for the fixation belt 51 to be cooled to its target temperature level by the natural heat radiation.

Table 3 is a summary of FIG. 6, regarding the lengths of time required for the fixing device 9 (image forming apparatus 100) to become ready for an image forming operation in which the recording medium is thin paper, immediately after 200 sheets of thick paper 2 were continuously conveyed for image formation.

TABLE 3

| | Cooling method | | Cooling durations | | |
|---|---|---|---|---|---|
| | Fixing | Pressing | Fixing | Pressing | Waiting time |
| Emb 1 | Fan cooling | | 21 sec | 5 sec | 21 sec |
| Comp. Ex | No | Fan cooling | 43 sec | 3 sec | 43 sec |
| Prior art | Press-contact | Fan cooling | 11 sec | 30 sec | 30 sec |

Referring to Table 3, in the case of the conventional cooling method, the air blowing fan 203 was used to cool only the pressure belt 52, whereas in the case of the cooling method in this embodiment, the air blowing fan 203 was combined with the mechanism 207 for pivotally moving the pressure belt 52, to make it possible to cool both the fixation belt 51 and pressure belt 52. In the case of the cooling method in the first embodiment, therefore, the fixation belt 51 and pressure belt 52 were simultaneously cooled, which made the cooling method in this embodiment shorter in the total amount of time necessary to reduce the temperatures of the fixation belt 51 and pressure belt 52 to their target levels than the conventional cooling method, and the comparative cooling method in which either the fixation belt 51 or pressure belt 52 is cooled through natural heat radiation.

Figure 7:
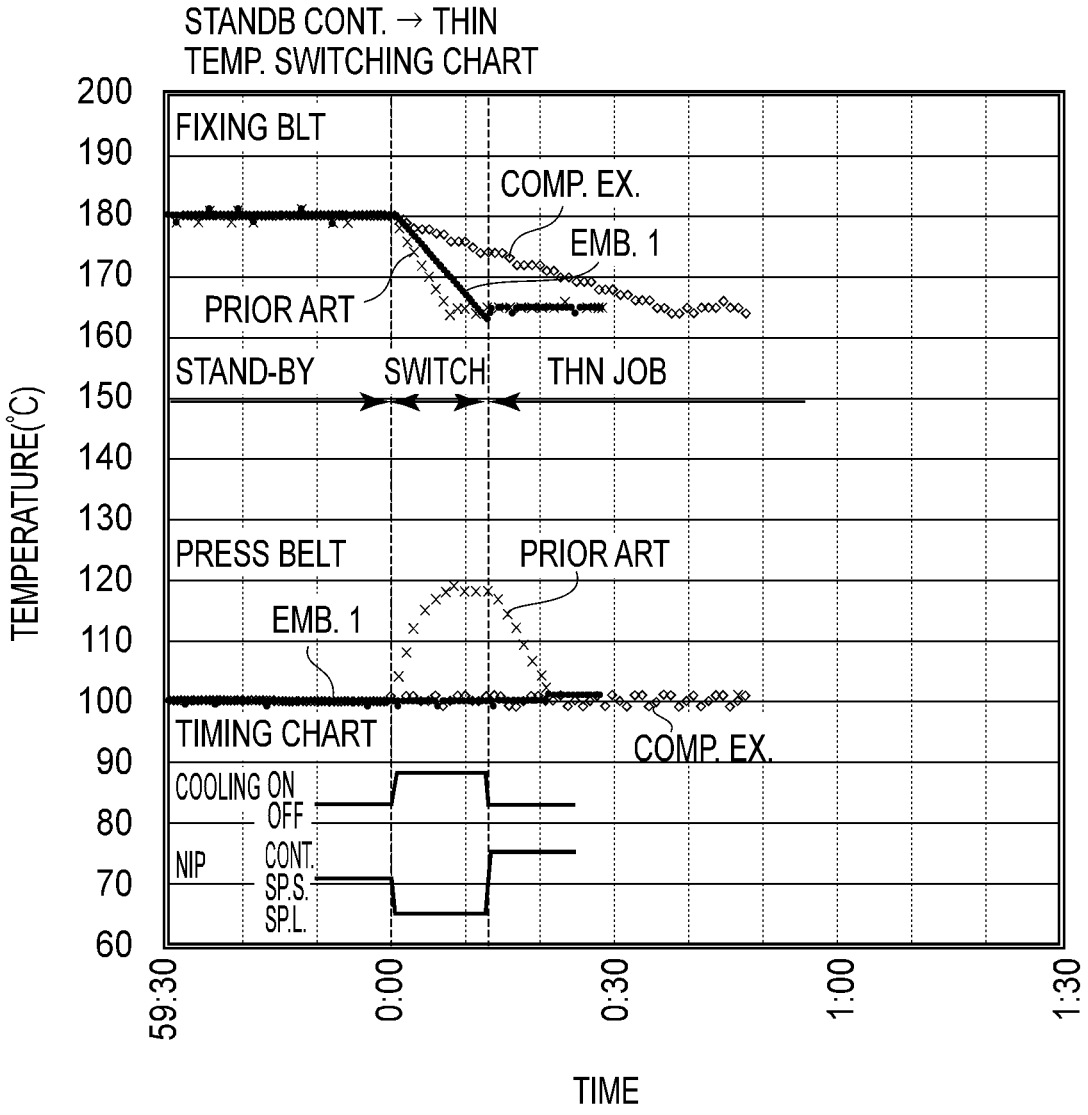
FIG. 7 is a drawing for describing the difference in terms of cooling performance (changes in temperature of fixation belt and pressure belt) among the image heating device in the first embodiment, comparative image heating device, and conventional image heating device, which occurred as thin paper was selected as recording medium while the image forming apparatus was kept on standby.

FIG. 7 is a drawing for illustrating the results of an experiment in which the cooling method in this embodiment, comparative cooling method, and conventional cooling method were tested in effectiveness after the thin paper was selected as the recording medium while the image forming apparatus was kept on standby. In the case of the cooling method in this embodiment, the pressure belt 52 was pivotally moved as shown in FIG. 4 to confirm the effectiveness of the cooling method in this embodiment after thin paper was selected as the recording medium.

Referring to Table 2, the default setting for the standby target temperature is 180° C. for the fixation belt 51, and 100° C. for the pressure belt 52. Next, referring to Table 1, the referential values for the highest temperature levels at image forming operation in which thin paper is the recording medium can be started is 165°C/110°C (fixation belt/pressure belt.) Therefore, both the fixation belt 51 and pressure belt 52 had to be cooled before it became possible for thin paper to be used as the recording medium.

The results of the controlling (cooling) method in this embodiment are indicated by round black dots (bold line) in FIG. 7. In the case of the control in this embodiment, the image forming apparatus 100 was kept on standby until 0 minute 0 second, and the fixation belt 51 and pressure belt 52 began to be cooled at 0 minute 0 second, with the pressure belt 52 kept separated from the fixation belt 51 as shown in FIG. 4(*a*). The temperature of the fixation belt 51 reduced to a target level of 165° C. with the elapse of 13 seconds. Then, the pressure belt 52 was placed close to the fixation belt 51 as shown in FIG. 4(*b*), and the pressure belt 52 was cooled. At this point in time, however, the temperature of the pressure belt 52 had reduced to 100° C. Therefore, the job in which thin paper was used as the recording medium was started at the same time as the cooling of the fixation belt 51 was completed.

The result of the conventional control is represented by the multiplication signs in FIG. 7. In the case of the conventional control, the image forming apparatus 100 was kept on standby until 0 minute 0 second, and the cooling of the fixation belt 51 was started at 0 minute 0 second through the pressure belt 52 which was in contact with the fixation belt 51. As a result, the pressure belt 52 was increased in temperature, requiring no less than 10 seconds to cool the pressure belt 52.

The comparative control is represented by rhombic dots. The image forming apparatus 100 was kept on standby until 0 minute 0 second, and only the pressure belt 52 began to be cooled at 0 minute 0 second, with the presence of a small distance between the fixation belt 51 and pressure belt 52. As for the fixation belt 51, the electric power supply to the first heating element 201 for the fixation belt 51 was stopped so that the fixation belt 51 was cooled by natural heat radiation. As a result, it took 40 seconds to cool the fixation belt 51.

Table 4 is a summary of the lengths of time it took for the controls in this embodiment, comparative control, and conventional control to ready the image forming apparatus 100, which was kept on standby, for a printing operation which used thin paper as the recording medium.

TABLE 4

| | Cooling method | | Cooling durations | | |
|---|---|---|---|---|---|
| | Fixing | Pressing | Fixing | Pressing | Waiting time |
| Emb 2 | Fan cooling | | 13 sec | No | 13 sec |
| Comp. Ex | No | Fan cooling | 40 sec | No | 40 sec |
| Prior art | Press-contact | Fan cooling | 8 sec | 20 sec | 20 sec |

Referring to Table 4, even in the case in which the target temperatures were switched while the image forming apparatus 100 was kept on standby, the control in this embodiment simultaneously cooled both the fixation belt 51 and pressure belt 52. Therefore, the control in this embodiment was substantially shorter in downtime than the comparative and conventional controls which left the cooling of either the fixation belt 51 or pressure belt 52 to natural heat radiation.

As described above, in the case in which the target temperatures for the fixation belt 51 and/or pressure belt 52 are switched during the execution of a "serial job", that is, a job made up of a serial combination of small jobs which are different in the recording medium, or while the image forming apparatus 100 is kept on standby, the control in this embodiment operates the image forming apparatus 100 in the first cooling mode. Therefore, it is very effectively to cool the fixation belt 51 while preventing the excessive increase in the temperature of the pressure belt 52, which is one of the causes of the formation of unsatisfactory images by the image forming apparatus 100.

In the first cooling mode, the pressure belt 52 is kept separated from the fixation belt 51 by a substantial distance. Therefore, the airflow generated toward the fixing device 9 by the air blowing fan 203 can simultaneously cool both the fixation belt 51 and pressure belt 52 by flowing between the fixation belt 51 and pressure belt 52. In the second cooling mode, the pressure belt 52 is kept separated from the fixation belt 51*by* only a small distance. Therefore, the airflow generated toward the fixing device 9 by the air blowing fan 203 is concentrated upon the pressure belt 52, cooling therefore only the pressure belt 52. That is, in this embodiment, the pressure belt 52 can be changed in attitude to control the distance between the fixation belt 51 and pressure belt 52. Therefore, both the fixation belt 51 and pressure belt 52, or only the pressure belt 52, can be cooled by the air blowing fan 203 without requiring the air blowing fan 203 to be changed in the direction in which the air blowing fan 203 generates airflow.

Further, in this embodiment, the temperature of the center portion of the fixation belt 51 in terms of the lengthwise direction of the fixation belt 51, and the temperature of the center portion of the pressure belt 52 in terms of the lengthwise direction of the pressure belt 52, are detected, and the distance between the fixation belt 51 and pressure belt 52 is controlled by changing the pressure belt 52 in attitude according to the target temperatures of the fixation belt 51 and pressure belt 52. Therefore, both the fixation belt 51 and pressure belt 52, or only the pressure belt 52, can be selectively cooled. Therefore, the control in this embodiment can make the temperature of the fixation belt 51 and that of the pressure belt 52 reach their target levels within the least amount of time, that is, as quickly as possible, within the range of the cooling capacity of the air blowing fan 203.

Incidentally, the fixing device 9 in this embodiment is structured so that, first, (a) the pressure belt 52 is changed in attitude by the pressure belt pivoting mechanism 200, and then, (b) the airflow generated by the air blowing fan 203 is changed in direction with the use of the aforementioned airflow direction changing member 21. However, this embodiment is not intended to limit the present invention in terms of the structure of the fixing device 9. For example, the fixing device 9 may be structured so that the airflow can be simply changed in direction, that is, toward the pressure belt 52, or the space between the fixation belt 51 and pressure belt 52, (b) by changing the airflow direction by the airflow direction changing member 210, or (a) by changing the surface of the pressure belt 52 in position with the use of the pressure belt pivoting mechanism 200.

<Embodiment 2>

Figure 8:
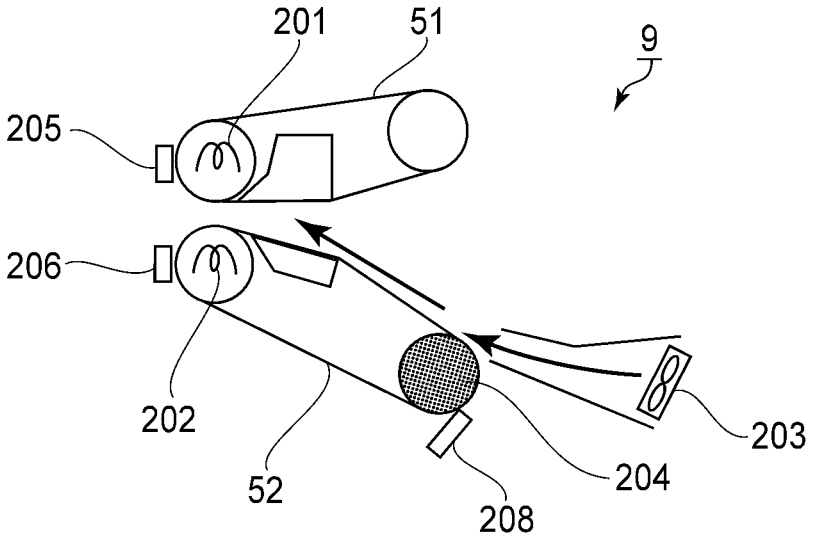
FIG. 8 is a drawing for describing the structure of the belt cooling system in the first embodiment.
Figure 8:
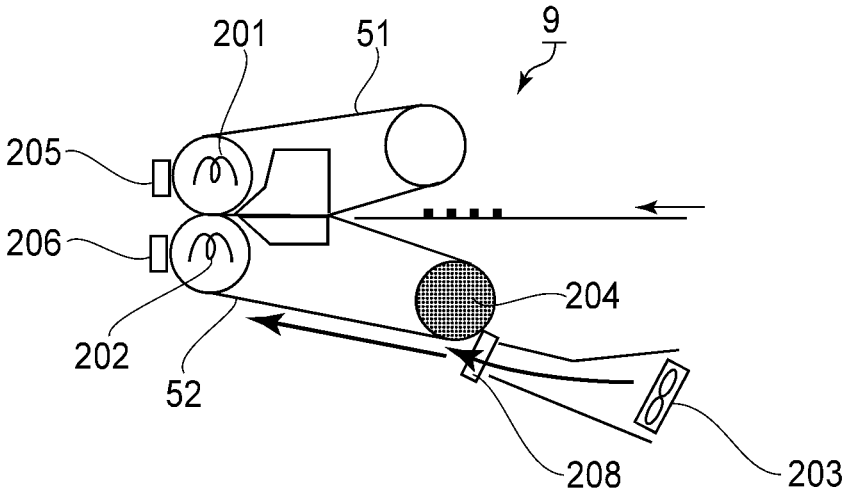
Figure 9:
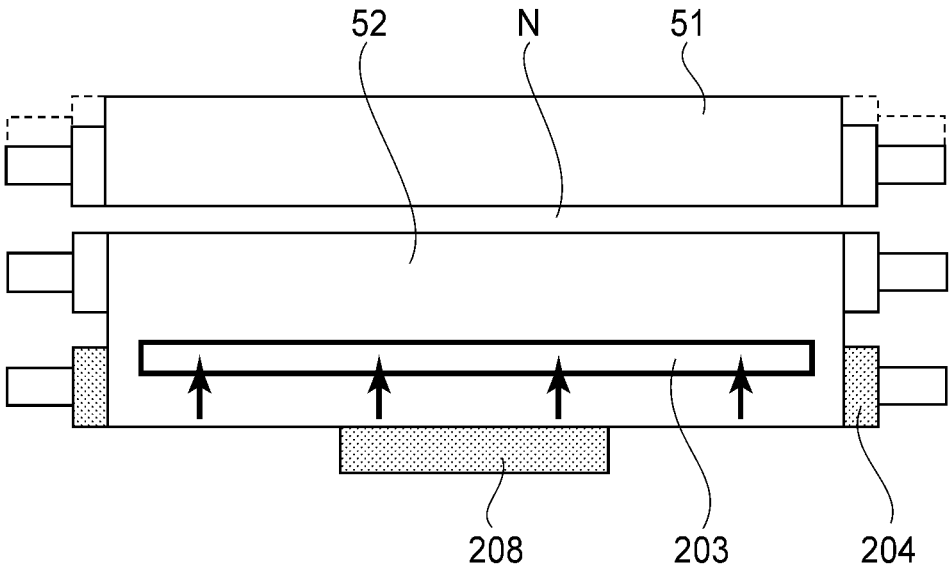
FIG. 9 is a drawing for describing how the belt cooling system is changed in the cooling area by an airflow direction changing member.
Figure 9:
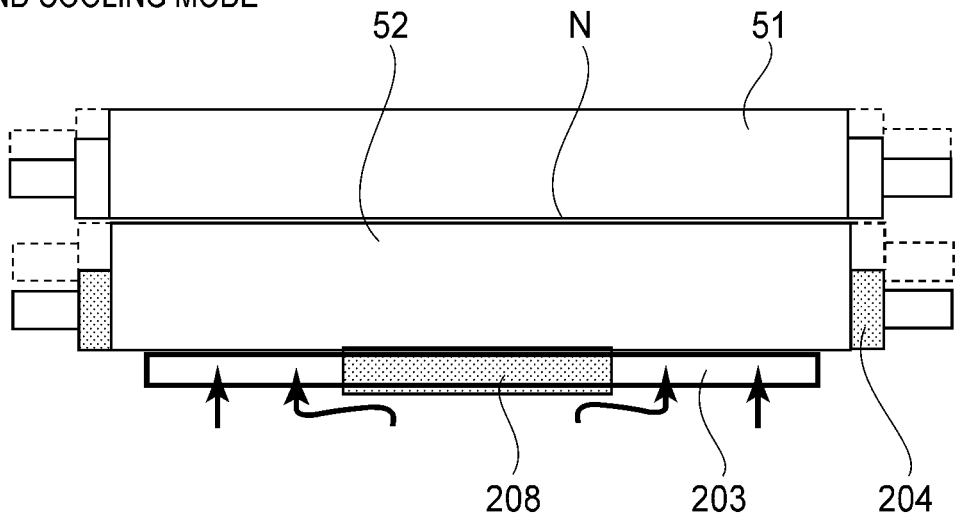
Figure 10:
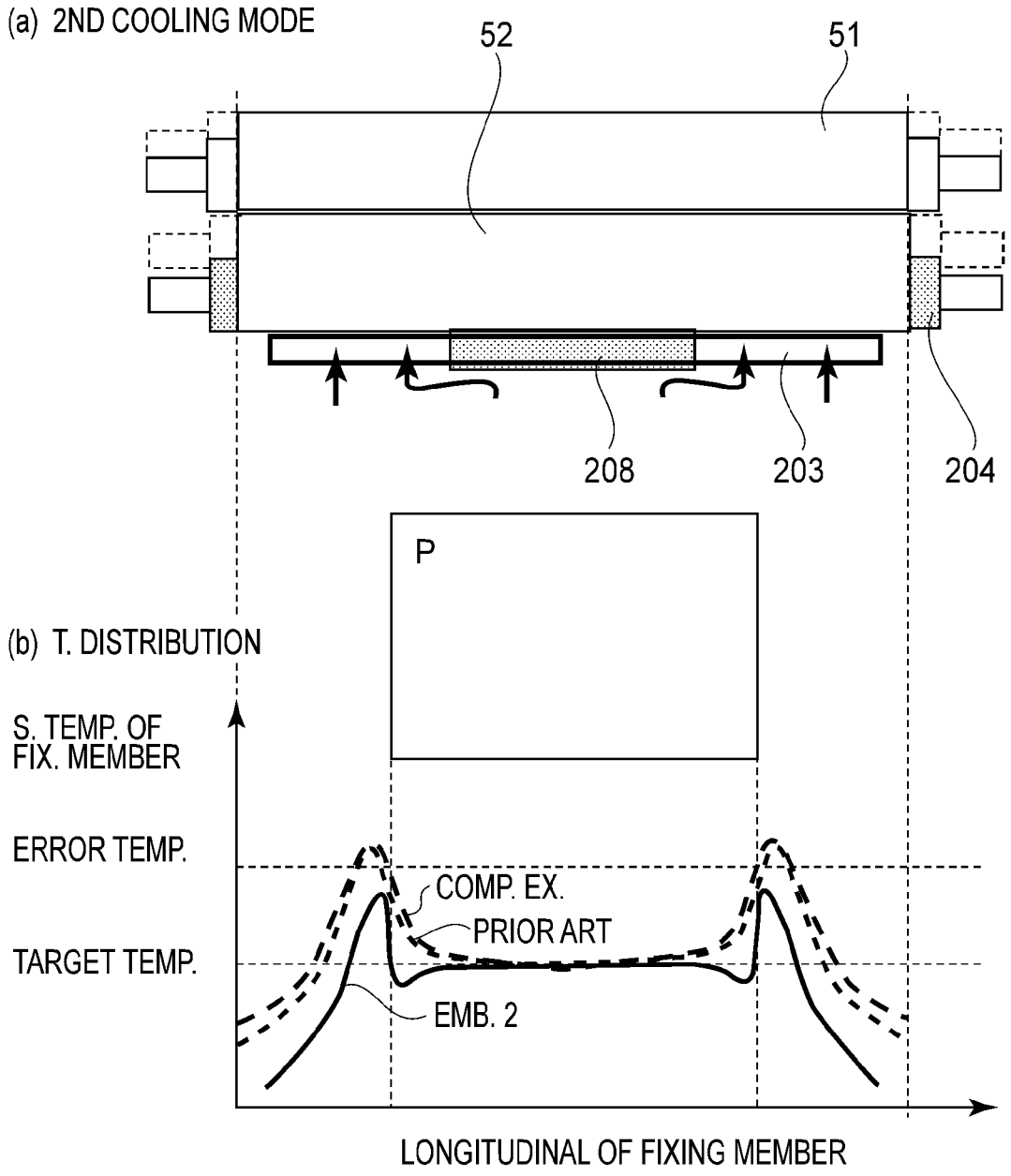
FIG. 10 is a drawing for describing the cooling effect of the belt cooling system in the second embodiment of the present invention.

Next, the second embodiment of the present invention is described. However, the features of the fixing device 9 in this embodiment, which are the same in description as the counterparts in the first embodiment, are not described; only the differences of the second embodiment from the first embodiment are described. FIG. 8 is a drawing for describing the belt cooling system in the second embodiment. FIG. 9 is a drawing for describing how the airflow generated by the air blowing fan 203 is changed in cooling area. FIG. 10 is a drawing for describing the cooling effect of the belt cooling system in the second embodiment. The second embodiment can prevent the problem that the portions of the fixation belt 51, which are out of the recording medium path, from increasing in temperature. Therefore, it can reduce the length of time a user has to wait until the portions of the fixation belt 51, which are out of the recording medium path cool down.

During a printing operation, the control section 141 keeps the pressure belt 52 in contact with the fixation belt 51, and controls the fixation belt 51 in temperature based on Table 1 which shows the target temperature levels for the fixation belt 51 and pressure belt 52 according to the recording medium type, with the use of the temperature control section 200. The temperature control section 200 controls the temperature of the fixation belt 51 based on the temperature level detected by the first temperature detection which is positioned at the center of the fixation belt 51 in terms of the widthwise direction of the fixation belt 51. Therefore, as a substantial number of sheets of the recording medium are continuously conveyed through the fixing device 9, the widthwise edge portions of the fixation belt 51, that is, the portions of the fixation belt 51, which are outside the recording medium path, gradually increase in temperature. As described above, the temperature control section 200 controls the first heating element so that the amount by which the fixation belt 51 is supplied with heat by the first heating element equals the amount by which heat is robbed from the recording medium path portion (center portion) of the fixation belt 51 by the recording medium. Therefore, the widthwise edge portions of the fixation belt 51, or the out-of-sheet-path portions of the fixation belt 51, which are not robbed of heat by the sheets of the recording medium, are made to increase in temperature by the heat supplied by the first heating element 201.

In the second embodiment, therefore, the fixing device 9 is provided with an airflow direction controlling member 208 in addition to the air blowing fan 203 so that while sheets of the recording medium are conveyed through the fixing device 9, the widthwise edge portions of the pressure belt 52 are cooled by the combination of the air blowing fan 203 and airflow direction controlling member 208, to indirectly cool the out-of-sheet-path portions of the fixation belt 51, which are in contact with the widthwise edge portions of the pressure belt 52, in order to prevent the out-of-sheet-path portions of the fixation belt 51 from excessively increasing in temperature.

Referring to FIG. 8, the fixing device 9 in the second embodiment is provided with the airflow direction controlling member 208, which is fixed in its positional relationship to the pressure belt 52. The airflow direction controlling member 208, which is an example of an airflow blocking member, is positioned so that it faces the center range of the pressure belt 52 to reduce the air blowing fan 203 in the ratio of the amount of the air blown toward the center range of the pressure belt 52 in the second cooling mode. That is, the airflow direction controlling member 208 is a structural component of the fixing device 9 in this embodiment, which is for removing heat from the out-of-sheet-path portions of the pressure belt 52, in the second cooling mode, that is, the cooling mode in which the pressure belt 52 is kept in contact with the fixation belt 51.

The airflow direction controlling member 208 is solidly positioned so that its positional relationship relative to the aforementioned pair of pivotally movable plates 113 which are at the lengthwise ends of the rotational axis of the pressure belt 52, one for one, does not change. The pressure belt 52, pressure roller 102, pressure pad 106, tension roller 104, and airflow direction controlling member are attached to the pivotally movable plate 113, making up a pressure application unit which is can be pivoted together with the pivotally movable pressure application plate 113 about the axis 111.

Like the pressure belt 52, pressure roller 102, second heating element 202 in the pressure roller 52, and second temperature detection element 206, the airflow direction controlling member 208 also is attached to the pivotally movable pressure application plate 113, with the unshown frame formed of metallic plate, making up an integral part of the pressure application unit. A user can place the pressure belt 52 in contact with the fixation belt 51, or optionally set the distance between the fixation belt 51 and pressure belt 52 by pivotally moving the pivotally movable pressure application plate 113, with the use of the pressure belt pivoting mechanism 207.

Referring to FIG. 8(*a*), the airflow direction controlling member 208 is positioned so that when the pressure belt 52 is kept separated from the fixation belt 51, the airflow direction controlling member 208 does not block the airflow generated by the air blowing fan 203 in the direction to flow along the pressure belt 52 to cool the fixation belt 51. Therefore, the airflow is not blocked by the airflow direction controlling member 208, reaching thereby both the fixation belt 51 and pressure belt 52 as shown in FIG. 9(*a*). The cooling effect of the first cooling mode, that is, the mode in which the image forming apparatus 100 is operated in a case where the target temperatures for the fixation belt 51 and/or pressure belt 52 are switched during the "serial job" described in the description of the first embodiment, or while the image forming apparatus 100 is kept on standby, is not lost.

Next, referring to FIG. 8(*b*), the airflow direction controlling member 208 is positioned so that while the pressure belt 52 is kept in contact with the fixation belt 51, the airflow generated by the air blowing fan 203 in the direction of the pressure belt 52 is prevented from hitting the central range of the pressure belt 52 in terms of the widthwise direction of the pressure belt 52. That is, the airflow direction controlling member 208 is positioned so that while the pressure belt 52 is kept in contact with the fixation belt 51, the airflow generated by the air blowing fan 203 in the direction of the pressure belt 52 is made to flow on the outward side of the airflow direction controlling member 208 in terms of the widthwise direction of the member 208, and cools the widthwise edge portions of the pressure belt 52 as shown in FIG. 9(*b*). Therefore, the problem that the widthwise edge portions of the fixation belt 51, more specifically, the portions of the fixation belt 51, which are outside the recording medium path, excessively increase in temperature, can be prevented by operating the image forming apparatus 100 in the second cooling mode, with the air blowing fan 203 activated, to cool the edge portions of the pressure belt 52 in terms of the widthwise direction of the pressure belt 52.

FIG. 10(*a*) is a drawing for describing the cooling effect of the second cooling mode in the second embodiment. It shows how effectively the widthwise end portions of the pressure belt 52 were cooled. In the experiment performed to test the effect of the second cooling mode, the temperature distribution of the fixation belt 51 in terms of the direction parallel to the axial line of the fixation belt driving roller 101 was obtained immediately after 1,000 sheets of ordinary paper, which were A4 in size and 200 g in basis weight, were continuously conveyed through the fixing device 9 in the portrait position. Incidentally, when a sheet of ordinary paper, which is A4 in size is conveyed in the portrait position, the portions of the fixation belt 51, which are outside the recording medium path, are larger, and therefore, are more likely to excessively increase in temperature, than when the sheet is conveyed in the landscape position.

The conditions under which the experiment was carried out were 350 mm in the width of the opening of the air blowing fan 203, 140 mm in the width of the airflow direction controlling member 208, 400 mm in the width of the fixation belt 51, and 185 mm in the length of the fixation belt 51. Further, the target temperature for the fixation belt 51 was set to 190° C., and the rated highest temperature level for the fixation belt 51, which was set based on the expected durability of the fixation belt 51, was 220° C. Ordinarily, as the detected temperature level of the fixation belt 51 reaches 220° C., the recording medium conveyance is temporarily stopped. Then, it is started as the detected temperature level of the fixation belt 51 falls below 220° C. However, the experiment was for testing the temperature control in the second embodiment. Therefore, in order to accurately evaluate the temperature increase of the fixation belt 51 across its out-of-sheet-path portions, 1,000 sheets of paper were continuously conveyed without temporarily stopping the recording medium conveyance, even when the detected temperature level of the fixation belt 51 exceeded 220° C.

Given in Table 5 are the results of the experiment in which the control in the second embodiment (which operates the image forming apparatus 100 in the second cooling mode during an image forming operation in which sheets of paper are continuously conveyed), conventional control (which does not activate the air blowing fan 203 during an image forming operation in which sheets of paper are continuously conveyed), and comparative control (which cools the entire surface of the pressure belt 52 by activating the air blowing fan 203, during an image forming operation in which sheets of paper are continuously conveyed), were tested.

TABLE 5

| | Cooling range | Max. temp. | Temperature rise prevention at end portions (1000 sheets) | No. of processed sheets up to design temp. |
|---|---|---|---|---|
| Emb. 2 | Opposite ends | 212° C. | G | ≥1000 |
| Comp. Ex. | Whole surface | 226° C. | NG | 500 |
| Prior art | No | 224° C. | NG | 700 |

Referring to FIG. 10(*b*), in the case of the second embodiment, the image forming apparatus 100 was operated in the second cooling mode in an image forming operation in which a substantial number of sheets of paper were continuously conveyed. As a result, even in an image forming operation in which 1,000 sheets of paper were continuously conveyed, the temperature of the out-of-sheet-path portions of the fixation belt 51 was prevented from exceeding 212° C. In comparison, in the case of the conventional control which does not activate the air blowing fan 203 during an image forming operation in which a substantial number of sheets of paper are continuously conveyed, the temperature of the out-of-sheet-path portions of the fixation belt 51 reached as high as 224° C.

Further, in the case of the comparative fixing device which does not have the airflow direction controlling member 208, and cooled the entirety of the pressure belt 52 by activating the air blowing fan 203, during an image forming operation in which a substantial number of sheets of paper were continuously conveyed, the out-of-sheet-path portions of the fixation belt 51 became higher in temperature than those of the conventional fixing device, for the following reason. That is, in the case of the comparative fixing device, the central portion of the fixation belt 51, that is, the portion of the fixation belt 51, which was being controlled in temperature, was cooled. Thus, the first heating element 201 was increased in load, being thereby made to generate more heat. Consequently, the amount of the heat which the out-of-sheet-path portions of the fixation belt 51 were given also increased. Also in the case of the comparative fixing device, both the temperatures of the fixation belt 51 and pressure belt 52 had to be kept at their target levels. Thus, the comparative fixing device was greater in the amount of electric power consumption than the fixing device in the second embodiment; electrical power was wastefully consumed.

By the way, in reality, the fixing device 9 is provided with a third temperature detecting element (thermistor), which is positioned in contact with one of the out-of-sheet-path portions of the fixation belt 51, so that as the detected temperature of the out-of-sheet-path portion reaches 220°, which is the highest level in terms of the temperature rating of the fixation belt 51, the sheet conveyance is temporarily stopped to idle the image forming apparatus 100 until the out-of-sheet-path portions of the fixation belt 51 cool down to 200° C. When the temperature of the out-of-sheet-path portions of the fixation belt 51 is 220° C., it takes roughly three minutes for the out-of-sheet-path portions of the fixation belt 51 to cool down to 200° C. In other words, roughly 3 minutes are wasted.

In the case where the image forming apparatus 100 was operated in the second cooling mode, the out-of-sheet-path portions of the fixation belt 51 did not reach 220° C., or the highest temperature level which the fixation belt 51 can withstand from the standpoint of design. Thus, even during an image forming operation in which 1,000 sheets of paper were continuously conveyed through the fixing device, the apparatus 100 was not idled even once for cooling. In comparison, in the case of the conventional fixing device, the temperature of the out-of-sheet-path portions of the fixation belt 51 reached once to 220° C., or the highest temperature level which the fixation belt 51 can with stand from the stand point of its design, and the apparatus 100 had to be idled for roughly 3 minutes for cooling. In the case of the comparative fixing device, the temperature of the out-of-sheet-path portions of the fixation belt 51 reached twice 220° C., or the highest temperature level which the fixation belt 51 can with stand from the standpoint of its design, and the apparatus 100 had to be idled for roughly six minutes; a user had to wait roughly 6 minutes.

As described above, in the case of the fixing device in the second embodiment, it is provided with the airflow direction controlling member 208, and the excessive increase in the temperature of the out-of-sheet-path portions of the fixation belt 51 is prevented by operating the image forming apparatus 100 in the second cooling mode, that is, the cooling mode in which the pressure belt 52 is kept in contact with the fixation belt 51. Thus, the out-of-sheet-path portions of the fixation belt 51 are very effectively prevented from excessively increasing in temperature even during a job in which a substantial number of sheets of recording medium are continuously conveyed. In other words, the second embodiment of the present invention can improve a fixing device (image forming apparatus) in terms of the length of time the image forming apparatus has to be idled (user has to wait) to cool the out-of-sheet-path portions of the fixation belt 51.

The above-described experiment proved the effectiveness of the second embodiment of the present invention, that is, the second embodiment can eliminate various problems attributable to the excessive temperature increase which occurs to the out-of-sheet-path portions of the fixation belt 51 during the execution of an image forming apparatus in which a substantial number of sheets of recording paper are continuously conveyed through the fixing device.

In the case of the fixing devices in the first and second embodiments, the heating nip, in which a sheet of the recording medium is heated, is formed by placing the pressure belt 52 in contact with the fixation belt 51 (heating belt). However, the first and second embodiments are not intended to limit the present invention in terms of the structure of a fixing device. For example, the present invention is also effectively applicable to a fixing device structured so that a pressure belt 52A is placed in contact with a heat roller 51A (FIG. 11).

Figure 11:
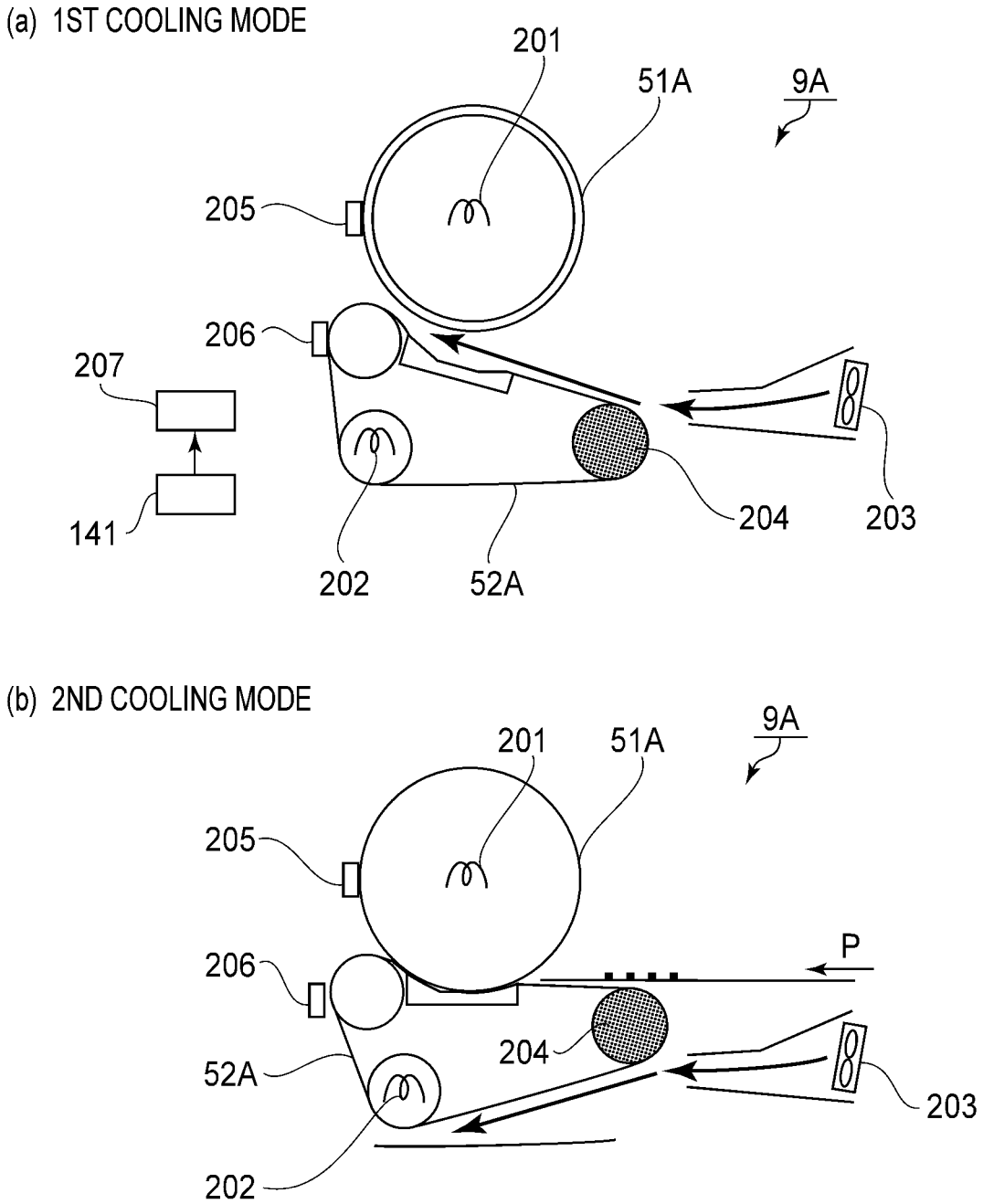
FIG. 11 is a drawing for describing the cooling mode of the fixing device having a fixation roller, instead of a combination of a rotational heating member and a heating belt.

Referring to FIG. 11(*b*), a heat nip N is formed by pressing the pressure belt 52A upon the fixation roller 51A. The fixing device 9A is structured so that the pressure belt 52A can be pivotally moved, like the pressure belt 52 in the first embodiment, by the pressure belt pivoting mechanism 207. In the first cooling mode, the pressure belt 52A is kept separated from the fixation roller 51A, and the airflow which moves along the pressure belt 52A cools the fixation roller 51A, as shown in FIG. 11(*a*). In the second cooling mode, the pressure belt 52A is kept a minute distance away from the fixation roller 51A, and therefore, the airflow generated by the air blowing fan 203 in the direction of the fixation roller 51A is blocked by the pressure belt 52A.

In the preceding embodiments of the present invention, the image forming apparatus was a color printer of the tandem type, and also, of the intermediary transfer type. That is, the image forming apparatus was structured so that image forming stations were aligned in tandem along the intermediary image bearing member. However, these embodiments are not intended to limit the present invention in terms of the structure of an image forming apparatus. For example, the present invention is also applicable to a color printer of the intermediary transfer/single drum type, which sequentially forms multiple monochromatic images, different in color, on its single image bearing member, and transfers the toner images onto its intermediary transfer member, a color printer of the tandem/direct transfer type, which does not have an intermediary transfer member, and directly transfers multiple monochromatic toner images, different in color, from its image bearing member onto a sheet of the recording medium. Moreover, the present invention is also applicable to an image forming apparatus other than a printer. That is, it is applicable to a copying machine, a facsimile machine, etc.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 184295/2011 filed Aug. 26, 2011, which is hereby incorporated by reference.

What is claimed is:

1. An image heating apparatus comprising:

a heating rotatable member;

a belt cooperating with said heating rotatable member to form a nip for heating an image on recording material;

a heating device configured to heat said heating rotatable member;

a controller configured to control the temperature of said heating rotatable member at a first temperature when the recording material has a first thickness, and to control the temperature of said heating rotatable member at a second temperature, which is lower from the first temperature, when the recording material has a second thickness which is smaller than the first thickness;

an air feeding device configured to feed air to said belt during an image heating operation;

a moving mechanism configured to space said belt from said heating rotatable member; and an executing portion configured to execute an operation in a mode in which said air feeding device feeds the air into space between said belt and said heating rotatable member while said belt is spaced from said heating rotatable member with said belt and said heating member rotating, wherein when the recording material having the second thickness is fed following the feeding of the recording material having the first thickness, said executing portion executes the operation in said mode after the recording material having the first thickness passes through the nip and before the recording material having the second thickness is fed into the nip.

2. An apparatus according to claim 1, further comprising a changing member configured to change the direction in which the air is fed, and wherein said changing member is configured to make the direction in which the air is fed be a direction toward said belt and not toward said heating rotatable member during the image heating operation, and said changing member is configured to make the direction in which the air is fed be a direction into the space between said belt and said heating rotatable member.

3. An apparatus according to claim 1, wherein said moving mechanism pivots said belt about a rotational axis positioned downstream of the nip with respect to a feeding direction of the recording material.

4. An apparatus according to claim 1, wherein said air feeding device is disposed at a position corresponding to an upstream side of said belt with respect to a feeding direction of the recording material.

5. An apparatus according to claim 1, further comprising a blocking member, disposed at a position corresponding to a widthwise central region of said belt, and configured to block the air directed toward the widthwise central region of said belt in the operation in said mode.

6. An image heating apparatus comprising:

a heating rotatable member;

a belt cooperating with said heating rotatable member to form a nip for heating an image on recording material;

a heating device configured to heat said heating rotatable member;

a controller configured to control said heating device so that the temperature of said heating rotatable member is at a target temperature which said controller sets in accordance with the kind of the recording material fed to the nip;

an air feeding device configured to feed air to said belt during an image heating operation;

a moving mechanism configured to space said belt from said heating rotatable member; and an executing portion configured to execute an operation in a mode in which said air feeding device feeds the air into a space between said belt and said heating rotatable member while said belt is spaced from said heating rotatable member with said belt and said heating member are rotating, wherein when a second recording material for which the target temperature is a second temperature is fed following a first recording material for which the target temperature is a first temperature, said executing portion executes the operation in said mode after the first recording material passes through the nip and before the second recording material is fed into the nip.

7. An apparatus according to claim 6, further comprising a changing member configured to change the direction in which the air is fed, wherein said changing member is configured to make the direction in which the air is fed to be toward said belt and not toward said heating rotatable member during the image heating operation, and said changing member is configured to make the direction in which the air is fed be a direction toward the space between said belt and said heating rotatable member.

8. An apparatus according to claim 6, wherein said moving mechanism pivots said belt about a rotational axis positioned downstream of the nip with respect to a feeding direction of the recording material.

9. An apparatus according to claim 6, wherein said air feeding device is disposed at a position corresponding to an upstream side of said belt with respect to a feeding direction of the recording material.

10. An apparatus according to claim 6, further comprising a blocking member, disposed at a position corresponding to a widthwise central region of said belt, and configured to block the air toward widthwise central region of said belt in the operation in said mode.

11. An image heating apparatus comprising:

heating rotatable member;

a belt cooperating with said heating rotatable member to form a nip for heating an image on recording material;

a heating device configured to heat said heating rotatable member;

a controller configured to control said heating device so that the temperature of said heating rotatable member is at a target temperature which said controller sets in accordance with the a kind of the recording material fed to the nip;

an air feeding device configured to feed air to said belt; and an executing portion configured to execute an operation in a first mode in which said air feeding device feeds the air into a space between said belt and said heating rotatable member while said belt and said heating member rotate and an operation in a second mode in which said air feeding device does not feed the air toward said heating rotatable member and feeds the air toward said belt while said belt and said heating rotatable member rotate, wherein said executing portion executes the operation in the second mode during the passing of the recording material through the nip, and wherein when a second recording material for which the target temperature is a second temperature is fed following a first recording material for which the target temperature is a first temperature, said executing portion executes the operation in the first mode after the first recording material passes through the nip and before the second recording material is fed into the nip.

12. An apparatus according to claim 11, further comprising a changing member configured to change the direction in which the air is fed to effect the first mode and the second mode.

13. An apparatus according to claim 11, wherein said air feeding device is disposed at a position corresponding to an upstream side of said belt with respect to a feeding direction of the recording material.

14. An apparatus according to claim 11, further comprising a blocking member, disposed at a position corresponding to a widthwise central region of said belt, and configured to block the air fed toward the widthwise central region of said belt in the operation in the first mode.

* * * * *